US010895230B2

(12) United States Patent
Kitagawa et al.

(10) Patent No.: US 10,895,230 B2
(45) Date of Patent: Jan. 19, 2021

(54) FUEL INJECTION DEVICE

(71) Applicant: DENSO CORPORATION, Kariya (JP)

(72) Inventors: Yuya Kitagawa, Kariya (JP); Daiji Ueda, Kariya (JP)

(73) Assignee: DENSO CORPORATION, Kariya (JP)

( * ) Notice: Subject to any disclaimer, the term of this patent is extended or adjusted under 35 U.S.C. 154(b) by 141 days.

(21) Appl. No.: 16/106,091

(22) Filed: Aug. 21, 2018

(65) Prior Publication Data

US 2019/0063384 A1 Feb. 28, 2019

(30) Foreign Application Priority Data

Aug. 29, 2017 (JP) ..... 2017-164683

(51) Int. Cl.
*F02M 47/02* (2006.01)
*F02M 63/00* (2006.01)

(52) U.S. Cl.
CPC ..... *F02M 47/027* (2013.01); *F02M 63/0026* (2013.01); *F02M 63/0028* (2013.01); *F02M 63/0035* (2013.01); *F02M 63/0045* (2013.01); *F02M 63/0056* (2013.01); *F02M 2547/008* (2013.01)

(58) Field of Classification Search
CPC ..... F02M 47/027; F02M 63/0035; F02M 63/0026; F02M 63/0045; F02M 63/0028; F02M 63/0056; F02M 2547/008
USPC ..... 239/584, 533.1–533.15, 88–92
See application file for complete search history.

(56) References Cited

U.S. PATENT DOCUMENTS

2005/0072856 A1* 4/2005 Ganser ..... F02M 61/12 239/96
2016/0230728 A1* 8/2016 Schuerz ..... F02M 51/0603
2016/0258404 A1* 9/2016 Tanada ..... F02M 61/14

FOREIGN PATENT DOCUMENTS

JP 2003-512562 4/2003
JP 2003512562 * 4/2003
JP 2016-053354 4/2016
JP 2016053354 * 4/2016

* cited by examiner

*Primary Examiner* — Qingzhang Zhou
*Assistant Examiner* — Joel Zhou
(74) *Attorney, Agent, or Firm* — Nixon & Vanderhye P.C.

(57) ABSTRACT

The pressing part includes an abutment part capable of being in contact with the inner peripheral surface of the pressing passage, and a depressed opposite part that is opposed to the exhaust port at a position away from the exhaust port in a perpendicular direction perpendicular to the displacement direction due to an outer peripheral surface of the pressing part recessed from the abutment part even when the abutment part is in contact with the inner peripheral surface of the pressing passage. When the abutment part is in contact with the inner peripheral surface of the pressing passage, a depression dimension of the depressed opposite part relative to the abutment part is set, such that an amount of fuel discharged from the valve chest is defined by the exhaust throttle part instead of a gap between the depressed opposite part and the inner peripheral surface of the pressing passage.

18 Claims, 12 Drawing Sheets

FUEL INJECTION DEVICE

CROSS REFERENCE TO RELATED APPLICATION

This application is based on Japanese Patent Application No. 2017-164683 filed on Aug. 29, 2017, the disclosure of which is incorporated herein by reference.

TECHNICAL FIELD

The present disclosure relates to a fuel injection device.

BACKGROUND

Examples of a fuel injection valve that injects fuel from an injection hole include a fuel injection device disclosed in JP 2016-53354 A, in which fuel pressure of a control chamber is varied with entrance and exit of the fuel into/from the control chamber, so that a nozzle needle closes/opens the injection hole. In this fuel injection device, a valve chest having a valve element is in communication with the control chamber by a control chamber channel, and an exhaust channel to exhaust the fuel is connected to the valve chest. Exhaust of fuel from the valve chest through the exhaust channel reduces fuel pressure in the control chamber. The exhaust channel has an out-orifice that throttles the exhaust channel. The out-orifice limits the amount of fuel exhausted from the valve chest and thus adjusts time required for reducing pressure in the control chamber.

The fuel injection device has a displacement-transmitting pin, which presses and displaces the valve element while being inserted through an insertion hole in communication with the valve chest. An exhaust port as an upstream end of the exhaust channel is formed in the inner circumferential surface of the insertion hole, so that the exhaust channel is in communication with the valve chest through the insertion hole. In this case, the outer circumferential surface of the displacement-transmitting pin is opposed to the exhaust port, and fuel flowing from the valve chest into the exhaust port passes through a gap between the outer circumferential surface of the displacement-transmitting pin and the inner circumferential surface of the insertion hole.

In such a configuration where the outer circumferential surface of the displacement-transmitting pin is opposed to the exhaust port, however, when the displacement-transmitting pin is axially deviated so as to approach the exhaust port, the displacement-transmitting pin may plug the exhaust port. If the displacement-transmitting pin excessively approaches the exhaust port in this way, the exhaust amount of fuel flowing through the exhaust channel is supposedly defined by the gap between the outer circumferential surface of the displacement-transmitting pin and the inner circumferential surface of the insertion hole rather than the orifice of the exhaust channel. Hence, if the displacement-transmitting pin is axially deviated and is thus close to or away from the exhaust port, the exhaust amount of fuel accordingly increases or decreases. As a result, time required for reducing the pressure in the control chamber varies, and in turn the amount of fuel injected from the injection hole unintentionally tends to vary.

SUMMARY

The present disclosure addresses at least one of the above issues. Thus, it is a primary objective of the present disclosure to provide a fuel injection device capable of suppressing an unintentional variation in fuel injection amount.

To achieve the objective of the present disclosure, there is provided a fuel injection device for injecting fuel through an injection hole, including a control chamber that fuel flows out from or flows into, an injection hole valve element that opens or closes the injection hole due to a change of fuel pressure in the control chamber made by the fuel flowing out from or flowing into the control chamber, a valve chest that is connected to the control chamber through a control chamber channel, an exhaust channel which is connected to the valve chest and through which to discharge fuel from the valve chest, an exhaust throttle part of the exhaust channel throttling the exhaust channel to limit a flow rate of fuel flowing through the exhaust channel, a control valve that is displaced in the valve chest to open or close the exhaust channel, a pressing part that extends in a displacement direction in which the control valve is displaced and that moves in the displacement direction to press the control valve, and a pressing passage which connects together the valve chest and the exhaust channel and through which the pressing part is inserted. An exhaust port, which is an upstream end portion of the exhaust channel, is provided on an inner peripheral surface of the pressing passage. The pressing part includes an abutment part capable of being in contact with the inner peripheral surface of the pressing passage, and a depressed opposite part that is opposed to the exhaust port at a position away from the exhaust port in a perpendicular direction perpendicular to the displacement direction due to an outer peripheral surface of the pressing part recessed from the abutment part even when the abutment part is in contact with the inner peripheral surface of the pressing passage. When the abutment part is in contact with the inner peripheral surface of the pressing passage, a depression dimension of the depressed opposite part relative to the abutment part is set, such that an amount of fuel discharged from the valve chest is defined by the exhaust throttle part instead of a gap between the depressed opposite part and the inner peripheral surface of the pressing passage.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
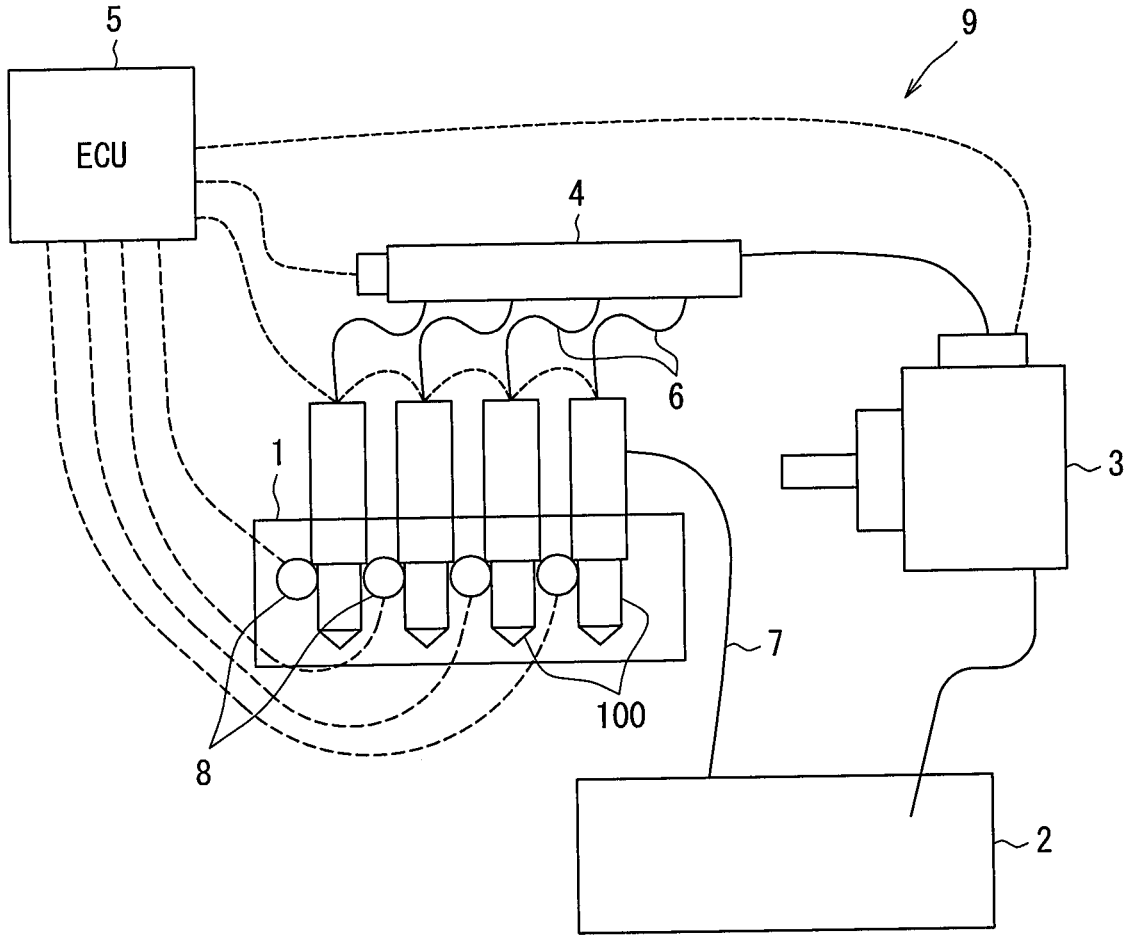
FIG. 1 is a schematic view illustrating a configuration of a fuel supply system of a first embodiment.

Hereinafter, some embodiments will be described with reference to the accompanying drawings. In the embodiments, corresponding components are designated by the same reference numeral, and duplicated description may be omitted. When only a portion of a configuration is described in each embodiment, other portions of the configuration can be described using previous description of a configuration of another embodiment. Not only a combination of configurations specified in description of each embodiment but also a combination of configurations in several embodiments can be used while being not specified as long as such a combination is not particularly disadvantageous. An unspecified combination of configurations described in the embodiments and modifications is also disclosed in the following description.

First Embodiment

Fuel injection valves 100 shown in FIG. 1 are included in a fuel supply system 9. The fuel supply system 9 further includes a fuel tank 2, a fuel supply pump 3, a common rail 4, and a control unit 5, and is mounted in a vehicle or the like. The fuel tank 2 stores fuel such as light oil. The fuel supply pump 3 pumps up the fuel from the fuel tank 2, pressurizes the fuel, and pressure-feeds the fuel to the common rail 4. The common rail 4 as an accumulator is connected to the plurality of fuel injection valves 100 via supply tubes 6, and temporarily stores the high-pressure fuel supplied from the fuel supply pump 3 and distributes the fuel to the respective fuel injection valves 100 while holding the fuel pressure.

The control unit 5 such as an engine control unit (ECU) is electrically connected to respective actuators for the fuel supply pump 3, the common rail 4, in-cylinder pressure sensors 8, the fuel injection valves 100, and the like, and controls operation of such actuators. The in-cylinder pressure sensor 8 is attached to the fuel injection valve 100 for each cylinder, and detects in-cylinder pressure in a combustion chamber or the like.

The fuel injection valve 100 operates by a drive current output from the control unit 5. The control unit 5 calculates a target injection amount based on an engine load, engine rotation speed, and the like, and calculates an injection period corresponding to the target injection amount according to pressure of the high-pressure fuel supplied to the fuel injection valve 100. The control unit 5 then adds an injection start delay time and an injection finish delay time to the calculated injection period to calculate a current application period, and outputs the drive current to the fuel injection valve 100 during the current application period.

The fuel injection valve 100, which is a hydraulic servo fuel injection device, injects fuel into a combustion chamber of an internal combustion engine 1 such as a diesel engine. The fuel injection valve 100 is inserted in an insertion hole of a cylinder head or the like forming the combustion chamber in the internal combustion engine 1, and is fixed to a head portion of the cylinder head in such a state. The fuel injection valve 100 has an injection hole 50 to inject the fuel, and uses part of the high-pressure fuel supplied from the supply tube 6 to open and close the injection hole 50. The fuel used to open and close the injection hole 50 is returned as a low-pressure fuel having a lower pressure than the high-pressure fuel from the fuel injection valve 100 to the fuel tank 2 through a return pipe 7.

Figure 2:
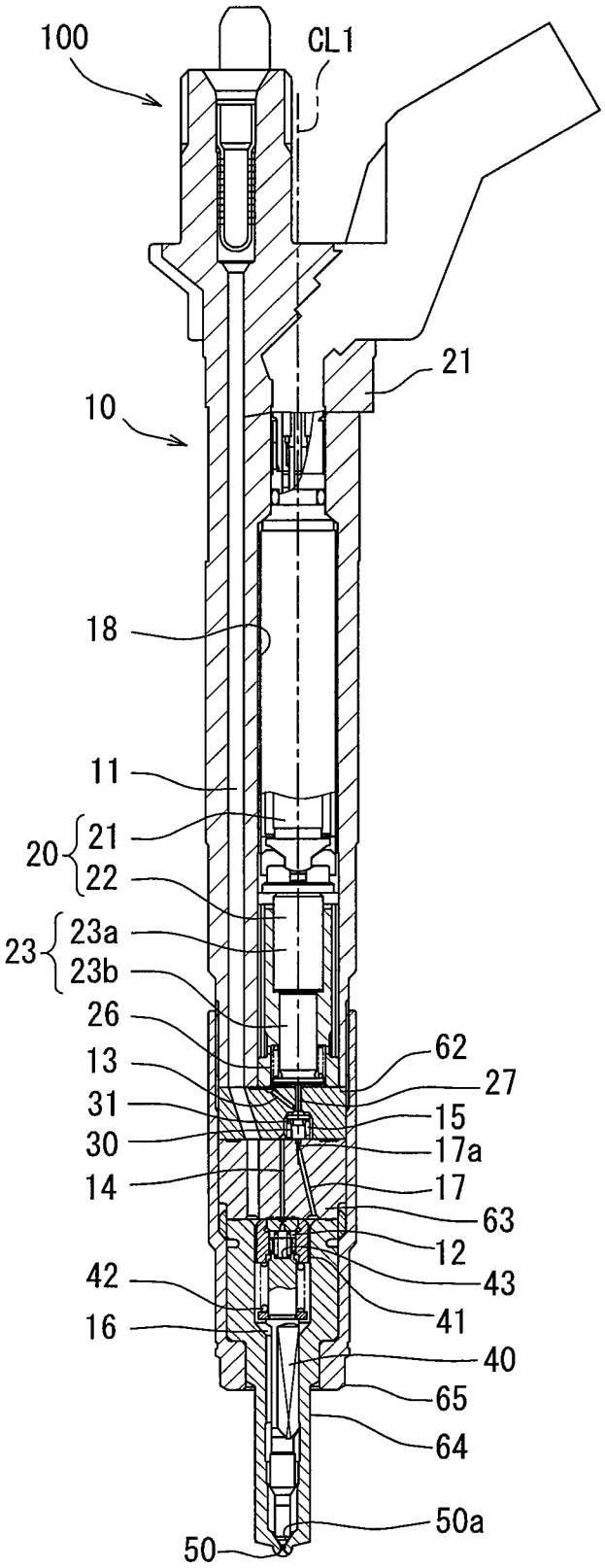
FIG. 2 is a longitudinal sectional view illustrating an internal structure of a fuel injection valve.

As shown in FIG. 2, the fuel injection valve 100 includes a valve body 10, a drive part 20, a control valve 30, a nozzle needle 40, and the injection hole 50. The nozzle needle 40 corresponds to "injection hole valve element". The drive part 20, the control valve 30, and the nozzle needle 40 are accommodated in a predetermined space provided in the valve body 10. The injection hole 50 is formed at a tip of the valve body 10.

The valve body 10 has an injection hole channel 11, a needle accommodation chamber 16, a pressure control chamber 12, a low-pressure channel 13, a control valve chest 15, and a drive part accommodation chamber 18. The injection hole channel 11 supplies the high-pressure fuel, which is supplied from the common rail 4 through the supply pipe 6, to the injection hole 50. The high-pressure fuel from the injection hole channel 11 flows into the needle accommodation chamber 16. The fuel injection pressure is therefore equal to the high-pressure channel pressure P. The pressure control chamber 12 corresponds to "control chamber", and the control valve chest 15 corresponds to "valve chest".

The needle accommodation chamber 16 accommodates the nozzle needle 40 that opens and closes the injection hole 50 formed in the valve body 10. The nozzle needle 40 is slidably held by a needle holding wall 41 provided within the needle accommodation chamber 16. The sliding direction of the nozzle needle 40 is along the axial direction of the valve body 10. A needle spring 42 is attached to the nozzle needle 40. The needle spring 42 applies a resilient force in the valve opening direction to the nozzle needle 40. The needle accommodation chamber 16 is in communication with the injection hole channel 11, and is filled with high-pressure fuel. The high-pressure fuel filling the needle accommodation chamber 16 exerts pressure in the valve opening direction of the nozzle needle 40.

The pressure control chamber 12 is provided on a side opposite to the injection hole 50 across the nozzle needle 40 in the inside of the valve body 10. The pressure control chamber 12 is a cylindrical space defined by the valve body 10, the needle holding wall 41, and the nozzle needle 40. Pressure of the fuel filling the pressure control chamber 12 is exerted on a needle pressure-receiving surface 43 formed in the nozzle needle 40. As a result, force in the valve closing direction of the nozzle needle 40 is exerted on the needle pressure-receiving surface 43.

The low-pressure channel 13 exhausts the fuel into the return pipe 7 and thus returns the fuel from the fuel injection valve 100 to the fuel tank 2. That is, the fuel in the fuel injection valve 100 is exhausted from the low-pressure channel 13 and adjusted thereby.

The control valve chest 15 is provided on a side opposite to the nozzle needle 40 across the pressure control chamber 12 in the inside of the valve body 10. The control valve chest 15 is a generally cylindrical space that accommodates the control valve 30 and a valve spring 31. The axial direction of the control valve chest 15 is along the axial direction of the valve body 10.

The valve body 10 has a plurality of channels connecting the control valve chest 15, the low-pressure channel 13, the needle accommodation chamber 16, and the pressure control chamber 12 to one another. The control valve chest 15 is connected to the needle accommodation chamber 16 by a high-pressure channel 17 that supplies the high-pressure fuel from the needle accommodation chamber 16 to the control valve chest 15. The high-pressure channel 17 can be referred to as a branched channel branched from the injection hole channel 11 through the needle accommodation chamber 16.

The high-pressure channel 17 corresponds to "supply channel", and the low-pressure channel 13 corresponds to "exhaust channel". The high-pressure channel 17 and its downstream end portion may be referred to as a high-pressure port, and the low-pressure channel 13 and its upstream end portion may be referred to as a low-pressure port. The high-pressure channel 17 may be directly branched from the injection hole channel 11 without running through the needle accommodation chamber 16.

The high-pressure channel 17 has an in-orifice 17*a* as a throttle part that throttles the high-pressure channel 17. The in-orifice 17*a* is disposed at a position near the needle accommodation chamber 16 in the high-pressure channel 17 and limits the inflow amount of the high-pressure fuel from the needle accommodation chamber 16 into the control valve chest 15. The in-orifice 17*a* may be disposed at a counter-injection-hole-side end portion of the high-pressure channel 17, or may be disposed at a position separate from the counter-injection-hole-side end portion of the high-pressure channel 17 on the injection hole side. In the first embodiment, a side close to the injection hole 50 is referred to as an injection hole side, and a side opposite to the injection hole 50 is referred to as a counter-injection-hole-side.

The control valve chest 15 is connected to the pressure control chamber 12 through a control chamber channel 14. The control chamber channel 14 is therefore communicable with each of the high-pressure channel 17 and the low-pressure channel 13 through the control valve chest 15. The control chamber channel 14 and its counter-injection-hole-side end portion may be referred to as a control chamber port.

Figure 3:
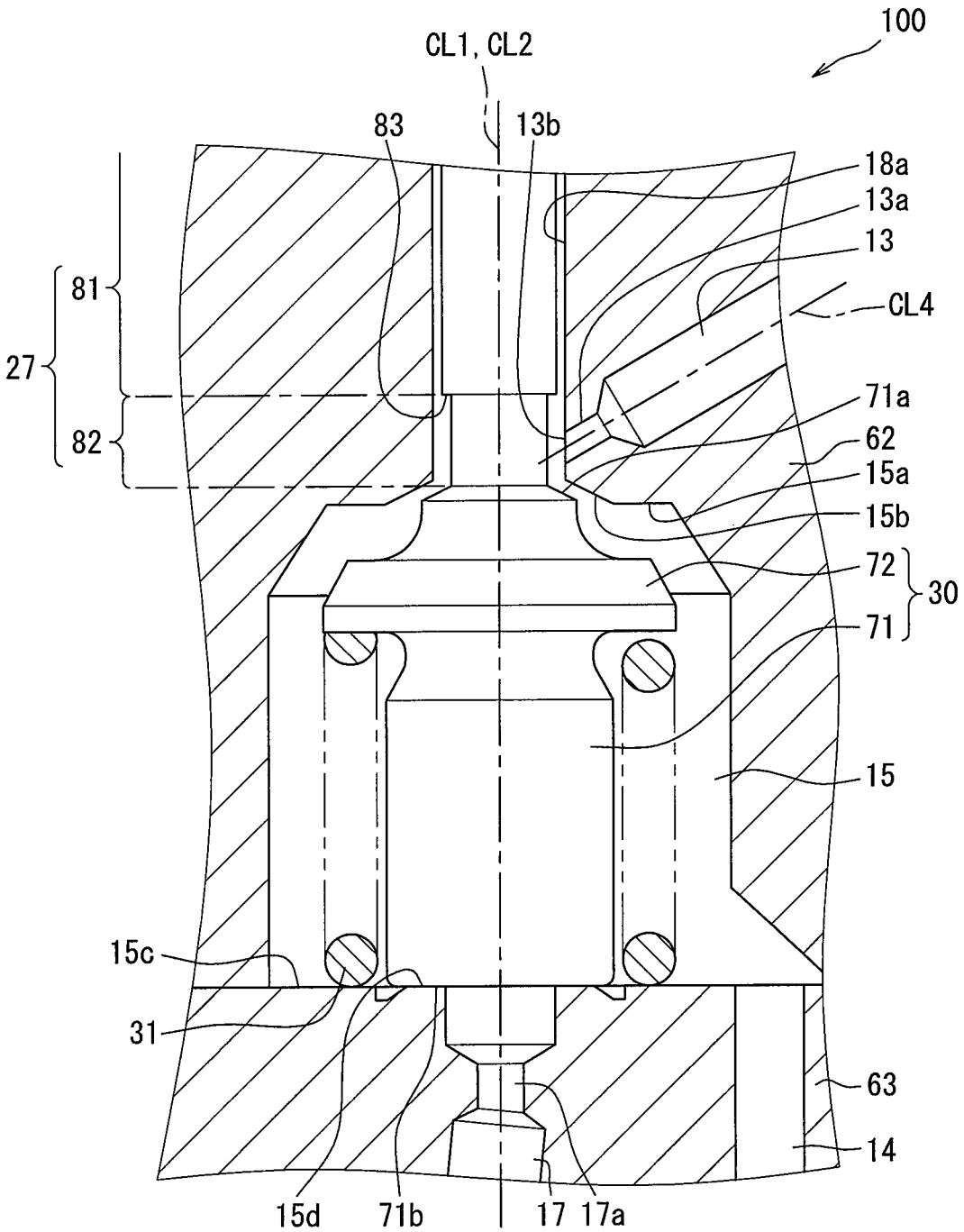
FIG. 3 is an expanded view around a control valve in FIG. 2.

As shown in FIGS. 2 and 3, the control valve chest 15 is in communication with the low-pressure channel 13 through a pin passage 18*a*. The pin passage 18*a*, which is an insertion hole in a form of a straight hole that straightly extends from the control valve chest 15 toward the counter-injection-hole-side, forms an injection-hole-side end portion of the needle accommodation chamber 16. The pin passage 18*a* is opened to the injection hole side and thus communicates with the control valve chest 15, and also communicates with the low-pressure channel 13 because the low-pressure channel 13 extends from the inner circumferential surface of the pin passage 18*a*. The center line CL1 of the pin passage 18*a* extends parallel to the center line of the fuel injection valve 100 or the valve body 10. The pin passage 18*a* extends straightly along the center line CL1 such that its inner circumferential surface is stretched from the injection-hole-side end portion to the counter-injection-hole-side end portion. The pin passage 18*a* corresponds to "pressure passage".

The low-pressure channel 13 has an out-orifice 13*a* as an exhaust throttle part that throttles the low-pressure channel 13. The out-orifice 13*a* is provided at a position near the pin passage 18*a* in the low-pressure channel 13, and limits the amount of the fuel exhausted from the control valve chest 15 into the return pipe 7 through the low-pressure channel 13. The out-orifice 13*a* forms the upstream end portion of the low-pressure channel 13, for example. A low-pressure port 13*b* as the upstream end portion of the low-pressure channel 13 is formed in the inner circumferential surface of the pin passage 18*a*, and corresponds to "exhaust port".

In a configuration where the control chamber channel 14 has an orifice that limits the amount of the fuel flowing from the pressure control chamber 12 to the control valve chest 15, the orifice may be referred to as an out-orifice while the out-orifice 13*a* is referred to as a sub out-orifice.

The control valve 30 is a three-way valve that selectively allows the high-pressure channel 17 or the low-pressure channel 13 to communicate with the control chamber channel 14. The control valve 30 may be referred to as an outward opening three-way valve. The control valve 30 is transferable between a first state where the low-pressure channel 13 is cut off and a second state where the high-pressure channel 17 is cut off. When the control valve 30 is in the first state, the control chamber channel 14 is in communication with the high-pressure channel 17, and thus the fuel is supplied from the high-pressure channel 17 into the control chamber channel 14, leading to an increase in pressure in the pressure control chamber 12. The control valve 30 closes the pin passage 18*a* to close the low-pressure channel 13. When the control valve 30 is in the second state, the control chamber channel 14 is in communication with the low-pressure channel 13, and thus the fuel is exhausted from the control chamber channel 14 into the low-pressure channel 13, leading to a decrease in pressure in the pressure control chamber 12.

A position of the control valve 30 in the first state may be referred to as an exhaust cutoff position for cutoff of the low-pressure channel 13 or pressure increase position for increase in pressure in the pressure control chamber 12. A position of the control valve 30 in the second state may be referred to as a supply cutoff position for cutoff of the high-pressure channel 17 or pressure reduction position for reduction in pressure in the pressure control chamber 12.

The control valve 30 moves in the axial direction along the center line CL1 of the pin passage 18*a* to transfer between the first and second states. The control valve 30 includes a valve body 71 having a generally cylindrical shape and a valve seat part 72 protruding from the outer circumferential surface of the valve body 71, and is made of a metal material or the like. Each of the center lines of the valve body 71 and the valve seat part 72 coincides with the center line of the control valve 30.

An upper valve seat surface 71*a* is included in a counter-injection-hole-side end surface of the valve body 71, and a ceiling seat surface 15*b* is included in a ceiling surface 15*a* facing the injection hole side in the inner circumferential surface of the control valve chest 15. The upper valve seat surface 71*a* has a circular shape extending along a peripheral edge of the counter-injection-hole-side end surface of the valve body 71, and the ceiling seat surface 15*b* has a circular shape extending along a peripheral edge of the injection-hole-side end portion of the pin passage 18*a*. The upper valve seat surface 71*a* is a curved surface that gradually expands toward the counter-injection-hole-side as closer to the center line of the control valve 30 in the radial direction. The ceiling seat surface 15*b* is a tapered surface that is gradually depressed toward the counter-injection-hole-side as closer to the inner circumferential end in the radial direction. The ceiling seat surface 15*b* is formed by a valve plate 62.

When the control valve 30 is in the first state, the upper valve seat surface 71*a* is in abutment with the ceiling seat surface 15*b*. The seat surfaces 71*a* and 15*b* are in tight contact with each other entirely around the pin passage 18*a*, and thus cut off communication between the control valve chest 15 and the low-pressure channel 13. When the control valve 30 is in the first state, a central portion of the counter-injection-hole-side end surface of the valve body 71 penetrates in the pin passage 18*a*.

A lower valve seat surface 71*b* is included in the injection-hole-side end surface of the valve body 71, and a floor seat surface 15*d* is included in a floor surface 15*c* facing the counter-injection-hole-side in the inner circumferential surface of the control valve chest 15. The lower valve seat surface 71*b* has a circular shape extending along the peripheral edge of the injection-hole-side end surface of the valve body 71, and the floor seat surface 15*d* has a circular shape extending along a peripheral edge of the counter-injection-hole-side end portion of the high-pressure channel 17. Each of the lower valve seat surface 71*b* and the floor seat surface 15*d* is a flat surface extending in the radial direction of the control valve chest 15 and of the control valve 30. The floor seat surface 15*d* is formed by a sheet surface on the counter-injection-hole-side of an orifice plate 63.

When the control valve 30 is in the second state, the lower valve seat surface 71*b* is in abutment with the floor seat surface 15*d*. The seat surfaces 71*b* and 15*d* are in tight contact with each other entirely around the high-pressure channel 17, and thus cut off communication between the high-pressure channel 17 and the control valve chest 15.

In the control valve chest 15, the counter-injection-hole-side end portion of the control chamber channel 14 is disposed on an outer side with respect to the injection-hole-side end portion of the control valve 30 in a direction orthogonal to the center line CL1. That is, the control chamber channel 14 is disposed at a position so as not to be opened and closed by the control valve 30.

The valve seat part 72 is disposed at an intermediate position of the valve body 71 in the axial direction of the control valve 30, and has a circular shape entirely around the valve body 71. The valve seat part 72 is disposed at a position that is separate from the upper valve seat surface 71*a* on the injection hole side and separate from the lower valve seat surface 71*b* on the counter-injection-hole-side in the axial direction. The valve seat part 72 is opposed to the orifice plate 63 across the valve body 71, and the valve spring 31 is sandwiched between the valve seat part 72 and the orifice plate 63.

Even when the control valve 30 is in the first state, the valve spring 31 is in abutment with the valve seat part 72 and the orifice plate 63 regardless of the state of the control valve 30 while being slightly contracted between the valve seat part 72 and the orifice plate 63. The valve spring 31 is in abutment with surfaces, any of which is a flat surface, as portions of an injection-hole side surface 72*a* of the valve seat part 72 and the floor surface 15*c* of the control valve chest 15. In this case, the valve spring 31 is allowed to rotate with its center line as a rotational axis with respect to the valve seat part 72 and the orifice plate 63. The valve spring 31 corresponds to a biasing component that biases the control valve 30 such that the control valve 30 is held in the first state.

The valve spring 31 is a coil spring formed by spirally winding a thin elongate member. The elongate member as a spring formation member forming the valve spring 31 is made of a metal material or the like. The valve spring 31 is, for example, a compression coil spring, and the spring formation member corresponds to a coil spring formation member. The valve spring 31 pushes the valve seat part 72 toward the counter-injection-hole-side to move the control valve 30 toward the counter-injection-hole-side. The control valve 30 moves toward the counter-injection-hole-side and thus transfers from the second state to the first state. The valve spring 31 has an inner diameter larger than the outer diameter of the valve body 71, and has an outer diameter smaller than the outer diameter of the valve seat part 72. The valve spring 31 is contracted so as to exhibit resilient force even when the control valve 30 is in the first state, and is thus constantly in abutment with both the injection-hole side surface 72*a* of the valve seat part 72 and the floor surface of the control valve chest 15. In FIG. 2, the control valve 30 is in the first state.

The drive part accommodation chamber 18 accommodates the drive part 20 that includes a piezo actuator 21, a displacement enlargement mechanism 22, and a drive pin 27. The piezo actuator 21 has one or more piezo elements. The piezo element is charged and thus elongated. Discharge of drive energy charged in the piezo element causes the piezo element to be contracted. The piezo actuator 21 of the first embodiment is configured by a piezo element stack including a plurality of piezo elements.

The displacement enlargement mechanism 22 enlarges the amount of displacement caused by expansion and contraction of the piezo actuator 21. The displacement enlargement mechanism 22 includes a sliding part 23, an oil-tight chamber 24, an assistant cylinder 25, and a piston spring 26. The sliding part 23 includes a piezo piston 23*a* and a valve piston 23*b*.

The assistant cylinder 25 has a cylindrical shape, and is externally fitted with the piezo piston 23*a* and the valve piston 23*b*. The assistant cylinder 25 defines the oil-tight chamber 24 between the piezo piston 23*a* and the valve piston 23*b*.

The piezo piston 23*a* is in contact with the piezo actuator 21. The valve piston 23*b* is disposed on a side opposite to the piezo piston 23*a* across the oil-tight chamber 24, and can displace the control valve 30 via the drive pin 27. The drive pin 27 is inserted through the pin passage 18*a* from the counter-injection-hole-side, and has an injection-hole-side end portion in abutment with the control valve 30 and a counter-injection-hole-side end portion in abutment with the valve piston 23*b*. However, the drive pin 27 is not joined to the control valve 30 nor the valve piston 23*b*. The drive pin 27 corresponds to "pressing part" that presses the control valve 30 toward the injection hole side. The drive pin 27 may be referred to as a drive transmission component that transmits driving force of the piezo actuator 21.

The piezo piston 23*a*, the valve piston 23*b*, and the drive pin 27 each have a cylindrical shape. Each of the center lines of the piezo piston 23*a* and the valve piston 23*b* coincides with the center line CL2 of the drive pin 27. A cross section orthogonal to the center line CL2 of the drive pin 27 is largest for the piezo piston 23*a* and smallest for the drive pin 27. The piston spring 26 applies a resilient force toward the control valve chest 15 to the valve piston 23*b*.

The drive pin 27 has a large-diameter pin part 81 forming its counter-injection-hole-side end portion and a small-diameter pin part 82 forming its injection-hole-side end portion. The large-diameter pin part 81 and the small-diameter pin part 82 each have a cylindrical shape, and the outer diameter of the small-diameter pin part 82 is smaller than the outer diameter of the large-diameter pin part 81. Each of the center lines of the large-diameter pin part 81 and the small-diameter pin part 82 coincides with the center line CL2 of the drive pin 27. The large-diameter pin part 81 extends from the valve piston 23*b* toward the injection hole side, and the small-diameter pin part 82 extends from the large-diameter pin part 81 toward the injection hole side. A pin stepped-surface 83 is formed at a boundary between the large-diameter pin part 81 and the small-diameter pin part 82, and has a circular shape facing the injection hole side.

The large-diameter pin part 81 corresponds to "abutment part" that may abut with the inner circumferential surface of the pin passage 18*a*, and the small-diameter pin part 82 corresponds to "depressed opposite part" as a part of the outer circumferential surface of the drive pin 27 depressed with respect to the large-diameter pin part 81. The small-diameter pin part 82 is opposed to the low-pressure port 13*b* at a position separate from the inner circumferential surface of the pin passage 18*a* in the radial direction of the small-diameter pin part 82 regardless of whether the outer circumferential surface of the large-diameter pin part 81 is in abutment with the inner circumferential surface of the pin passage 18*a*.

Figure 4:
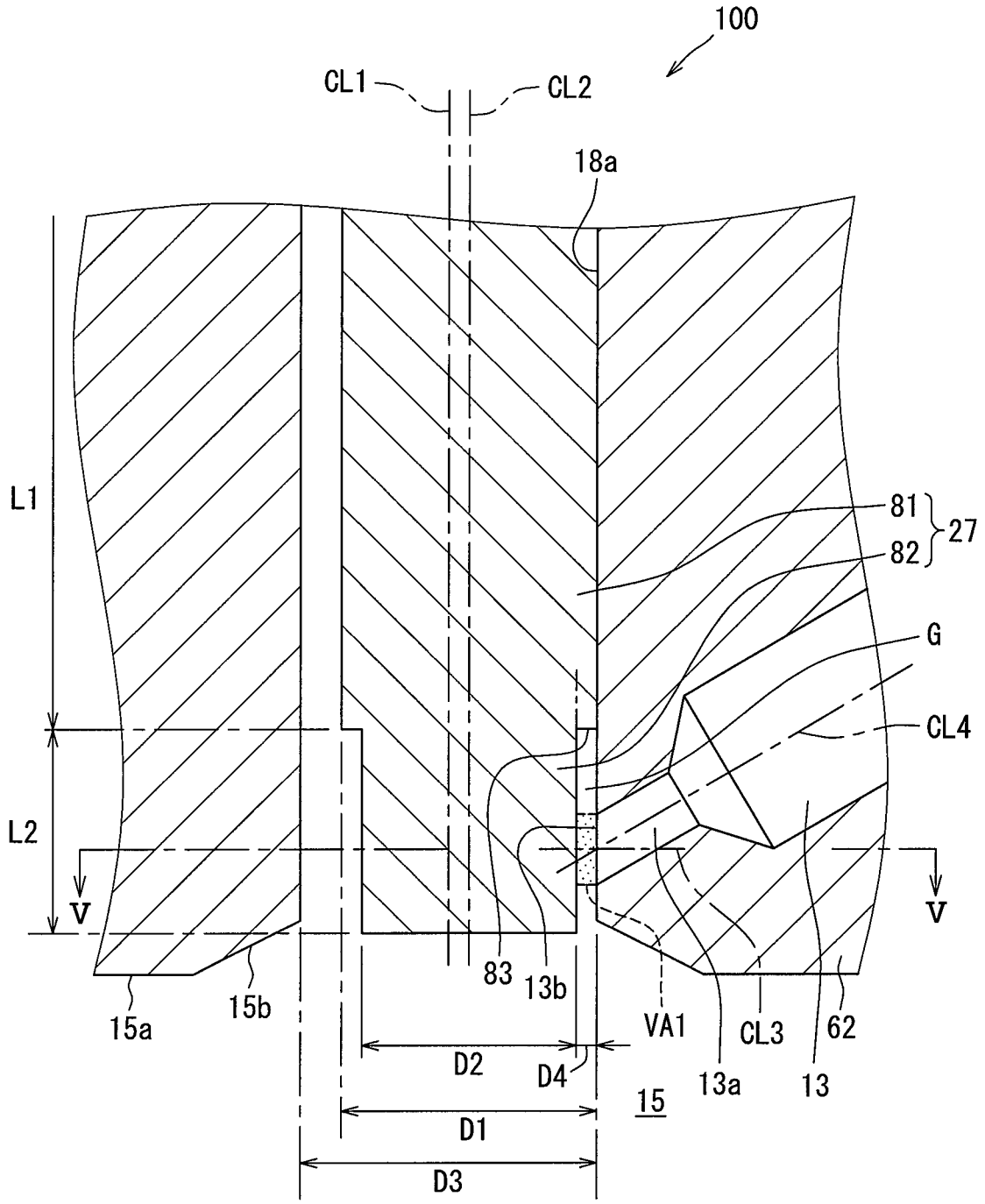
FIG. 4 is an expanded view around a small-diameter pin part in FIG. 3.

As shown in FIG. 4, the length dimension L2 of the small-diameter pin part 82 is smaller than the length dimension L1 of the large-diameter pin part 81 in the axial direction. The length dimension L2 of the small-diameter pin part 82 is larger than the outer diameter D2 of the small-diameter pin part 82, but smaller than each of the outer diameter D1 of the large-diameter pin part 81 and the inner diameter D3 of the pin passage 18*a*. The outer diameter D1 of the large-diameter pin part 81 is thus smaller than the inner diameter D3 of the pin passage 18*a* such that the large-diameter pin part 81 is allowed to move or slide in the pin passage 18*a*. In FIG. 4, illustration of the control valve 30 is omitted.

Returning to description of FIGS. 2 and 3, when the control valve 30 is in either of the first and second states, the small-diameter pin part 82 of the drive pin 27 is opposed to the low-pressure port 13*b*. When the control valve 30 is in the second state, the small-diameter pin part 82 is located nearest the injection hole side. In such a case, however, the pin stepped-surface 83 and the large-diameter pin part 81 are still disposed on the counter-injection-hole-side with respect to the low-pressure port 13*b* in the axial direction. When the control valve 30 is in the first state, while the small-diameter pin part 82 is located nearest the counter-injection-hole-side. In such a case, however, the injection-hole-side end portion of the small-diameter pin part 82 is still disposed on the injection hole side with respect the low-pressure port 13*b* and the inner circumferential end of the ceiling seat surface 15*b*. In this way, the injection-hole-side end portion of the small-diameter pin part 82 penetrates in the control valve chest 15 while being not accommodated in the pin passage 18*a* in either case where the drive pin 27 presses or does not press the control valve 30 toward the injection hole side.

The center line CL2 of the drive pin 27 extends parallel to the center line CL1 of the pin passage 18*a*, and FIG. 2 shows such center lines CL1 and CL2 in a coincident manner. The movement direction of the drive pin 27 is the axial direction along which the center line CL2 of the drive pin 27 extends, and corresponds to "displacement direction". The radial direction of the drive pin 27 is an orthogonal direction orthogonal to the center line CL2, and is orthogonal to the displacement direction. If the drive pin 27 is not inclined with respect to the pin passage 18*a*, the axial direction, along which the center line CL1 of the pin passage 18*a* extends, corresponds to the displacement direction, and the radial direction of the pin passage 18*a* corresponds to the orthogonal direction.

The injection hole 50 is formed on an end side in the insertion direction of the valve body 10 to be inserted into the combustion chamber. A plurality of injection holes 50 are radially provided from the valve body 10 side to the outside. The high-pressure fuel flowing into the needle accommodation chamber 16 is injected into the combustion chamber from the injection holes 50 formed in the needle accommodation chamber 16. Furthermore, the valve body 10 has one circular needle seat 50*a* so as to surround all the injection holes 50. The nozzle needle 40 is seated on the needle seat 50*a* to close the injection holes 50.

The valve body 10 includes a plurality of components such as a housing 61, the valve plate 62, the orifice plate 63, a nozzle body 64, and a retaining nut 65, which are each made of a metal material. The valve plate 62 and the orifice plate 63 are sandwiched between the housing 61 and the nozzle body 64, and the retaining nut 65 connects the housing 61 to the nozzle body 64 from an outer circumferential side.

The valve plate 62 is adjacent to the housing 61 in the axial direction, and the drive part accommodation chamber 18 is formed while striding the housing 61 and the valve plate 62. Specifically, most of the drive part accommodation chamber 18 is formed by an internal space of the housing 61, and the pin passage 18*a* is formed by a through-hole formed in the valve plate 62. In the valve plate 62, the pin passage 18*a* is formed by a counter-injection-hole-side portion of the through-hole, and the control valve chest 15 is formed by an injection-hole-side portion of the through-hole.

The orifice plate 63 has the control chamber channel 14 and the high-pressure channel 17. A sheet surface on the injection hole side of the valve plate 62 is superimposed on a sheet surface on the counter-injection-hole-side of the orifice plate 63, thereby both the control chamber channel 14 and the high-pressure channel 17 are in communication with the control valve chest 15. The nozzle body 64 is a bottomed cylindrical component, and accommodates the needle holding wall 41 and the needle spring 42 in its internal space. Each of the center lines of the drive part accommodation chamber 18, the control valve chest 15, and the high-pressure channel 17 coincides with the center line CL1 of the pin passage 18*a*.

Valve opening operation of the fuel injection valve 100 of the first embodiment is now described. The piezo actuator 21 is charged to be elongated. The piezo piston 23*a* that slides toward the control valve chest 15 by the assistant cylinder 25 along with displacement of the elongated piezo actuator 21. The piezo piston 23*a* is slidably displaced to increase pressure (hereinafter, referred to as oil pressure) of the fuel in the oil-tight chamber 24. That is, the sliding amount of the piezo piston 23*a* is converted into oil pressure in the oil-tight chamber 24. The oil pressure increases with sliding of the piezo piston 23*a*, thereby the valve piston 23*b* receives the oil pressure and slides within the assistant cylinder 25. The sectional area perpendicular to the axial direction of the valve piston 23*b* is smaller than the sectional area perpendicular to the axial direction of the piezo piston 23*a*. Consequently, force exerted on the valve piston 23*b* due to the increased oil pressure in the oil-tight chamber 24 is larger than force exerted on the fuel in the oil-tight chamber 24 by the piezo piston 23*a*. That is, displacement due to elongation of the piezo actuator 21 is enlarged through conversion into a pressure change, and transmitted as valve closing force to the control valve 30.

The valve piston 23*b* that has received the oil pressure slides and pushes the control valve 30 to the injection hole side via the drive pin 27. The control valve 30 then moves to the injection hole side and separates from the ceiling seat surface 15*b*, so that the control valve chest 15 becomes in communication with the low-pressure channel 13. When the valve piston 23*b* further pushes the control valve 30 to the injection hole side, the control valve 30 is pressed against the floor seat surface 15*d*, and thus the lower valve seat surface 71*b* becomes in tight contact with the floor seat surface 15*d*. When the control valve 30 thus transfers into the second state, the high-pressure channel 17, which supplies the high-pressure fuel into the control valve chest 15, is closed by the control valve 30, so that the high-pressure channel 17 is not in communication with the control valve chest 15. In this state, while inflow of the high-pressure fuel into the control valve chest 15 is stopped, the fuel in the control valve chest 15 flows out into the low-pressure channel 13. Pressure of the fuel in the control valve chest 15 is accordingly reduced, and pressure in the pressure control chamber 12, which is in communication with the control valve chest 15 through the control chamber channel 14, is also reduced, resulting in a reduction in force in the valve closing direction exerted on the needle pressure-receiving surface 43 of the nozzle needle 40. As a result, the nozzle needle 40 leaves from the needle seat 50*a*, so that the injection holes 50 are opened.

Valve closing operation of the fuel injection valve 100 of the first embodiment is now described. The piezo actuator 21 is discharged to be shortened and returns to a length in the uncharged state. In this case, the piezo piston 23*a* returns to the first state and thus fuel pressure in the oil-tight chamber 24 is reduced, and thus the valve piston 23*b* returns to the first state, and in turn the control valve 30 returns to the first state. In this state, the force, which has pressed the lower valve seat surface 71*b* of the control valve 30 against the floor seat surface 15*d*, is not exerted, thereby the high-pressure channel 17 becomes in communication with the control valve chest 15, and the high-pressure fuel flows into the control valve chest 15. On the other hand, the upper valve seat surface 71*a* becomes in tight contact with the ceiling seat surface 15*b*, thereby the low-pressure channel 13 is not in communication with the control valve chest 15, so that the control valve chest 15 is filled with the high-pressure fuel. In such a case, the pressure control chamber 12, which is in communication with the control valve chest 15 through the control chamber channel 14, is also filled with the high-pressure fuel, and thus pressure in the pressure control chamber 12 increases, resulting in an increase in pressure exerted on the needle pressure-receiving surface 43. As a result, the nozzle needle 40 is pressed against the needle seat 50*a*, so that the injection holes 50 are closed. The first state may be referred to as initial state.

Figure 5:
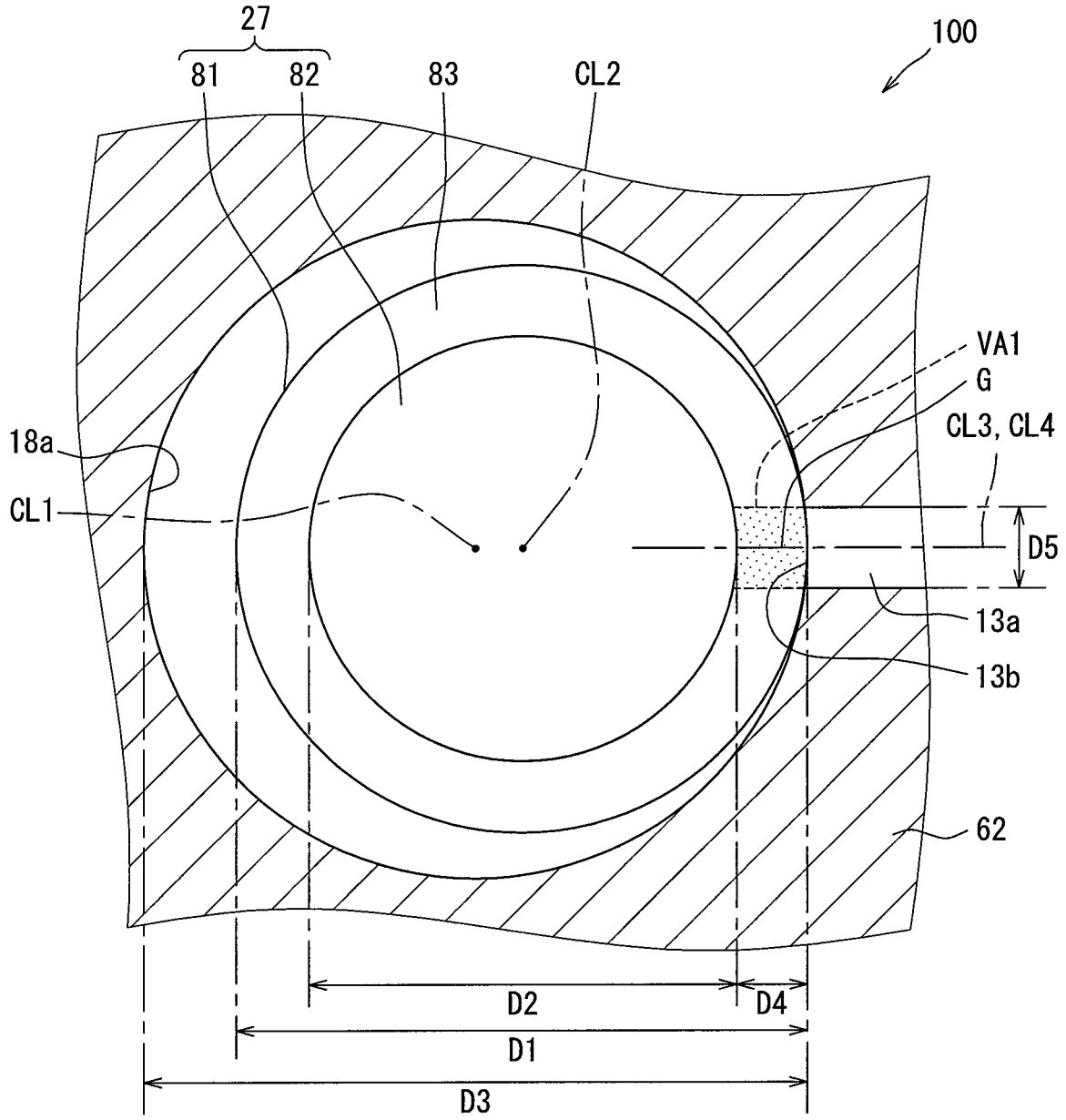
FIG. 5 is a sectional view along a line V-V, illustrating a configuration around a low-pressure port.

When the control valve 30 is in the second state, the fuel flowing from the control valve chest 15 into the low-pressure port 13*b* passes through a gap between the inner circumferential surface of the pin passage 18*a* and the outer circumferential surface of the small-diameter pin part 82. Relative displacement of the axis of the drive pin 27 to the control valve 30 or the valve piston 23*b* may cause axial deviation from the pin passage 18*a*. For example, as shown in FIGS. 4 and 5, when the drive pin 27 is displaced to a low-pressure port 13*b* side in the radial direction and thus the large-diameter pin part 81 is in abutment with the inner circumferential surface of the pin passage 18*a*, the clearance between the small-diameter pin part 82 and the low-pressure port 13*b* is minimized. In this way, when the small-diameter pin part 82 is closest to the low-pressure port 13*b*, the clearance between the small-diameter pin part 82 and the low-pressure port 13*b* is equal to a step dimension D4 as a lateral size of the pin stepped-surface 83 in the radial direction. The step dimension D4 corresponds to "depression dimension" of the small-diameter pin part 82 from the large-diameter pin part 81.

When the small-diameter pin part 82 is closest to the low-pressure port 13*b*, and if an in-passage gap G as a gap between the outer circumferential surface of the small-diameter pin part 82 and the inner circumferential surface of the pin passage 18*a* is too small, the exhaust amount of the fuel through the low-pressure channel 13 is defined by the in-passage gap G rather than the out-orifice 13*a*. With regard to this, in the first embodiment, the step dimension D4 of the pin stepped-surface 83 is set to an appropriately large value to prevent the in-passage gap G from being excessively small.

The step dimension D4 of the pin stepped-surface 83 is now described. In the first embodiment, when the small-diameter pin part 82 is closest to the low-pressure port 13*b*, the low-pressure port 13*b* is supposedly extended up to the small-diameter pin part 82 in the radial direction of the pin passage 18*a*, and a virtual region being such an extension is referred to as an extension region VA1. The extension region VA1 is a region stretched from the small-diameter pin part 82 to a projected portion formed by projecting the low-pressure port 13*b* onto the outer circumferential surface of the small-diameter pin part 82 in the radial direction. The extension region VA1 has a columnar shape extending along the center line CL3 of the low-pressure port 13*b*, and exists between the outer circumferential surface of the small-diameter pin part 82 and the low-pressure port 13*b*. The section of the extension region VA1 in a direction orthogonal to the center line CL3 has the same size and shape as those of the low-pressure port 13*b*. The extension region VA1 corresponds to a throttle region as an extension of the out-orifice 13*a* or "outlet region" as an extension of the low-pressure port 13*b*.

The out-orifice 13*a* has a circular section. On the other hand, since the out-orifice 13*a* is inclined with respect to both the axial direction and the radial direction of the pin passage 18*a*, the low-pressure port 13*b* has an elliptic shape on the inner circumferential surface of the pin passage 18*a*. For example, the out-orifice 13*a* extends from the low-pressure port 13*b* in a direction inclined to the counter-injection-hole-side with respect to the radial direction of the pin passage 18*a*. The extension region VA1 has a cylindroid shape because it extends along the center line CL3 of the low-pressure port 13*b* rather than the center line CL4 of the out-orifice 13*a*.

Figure 6:
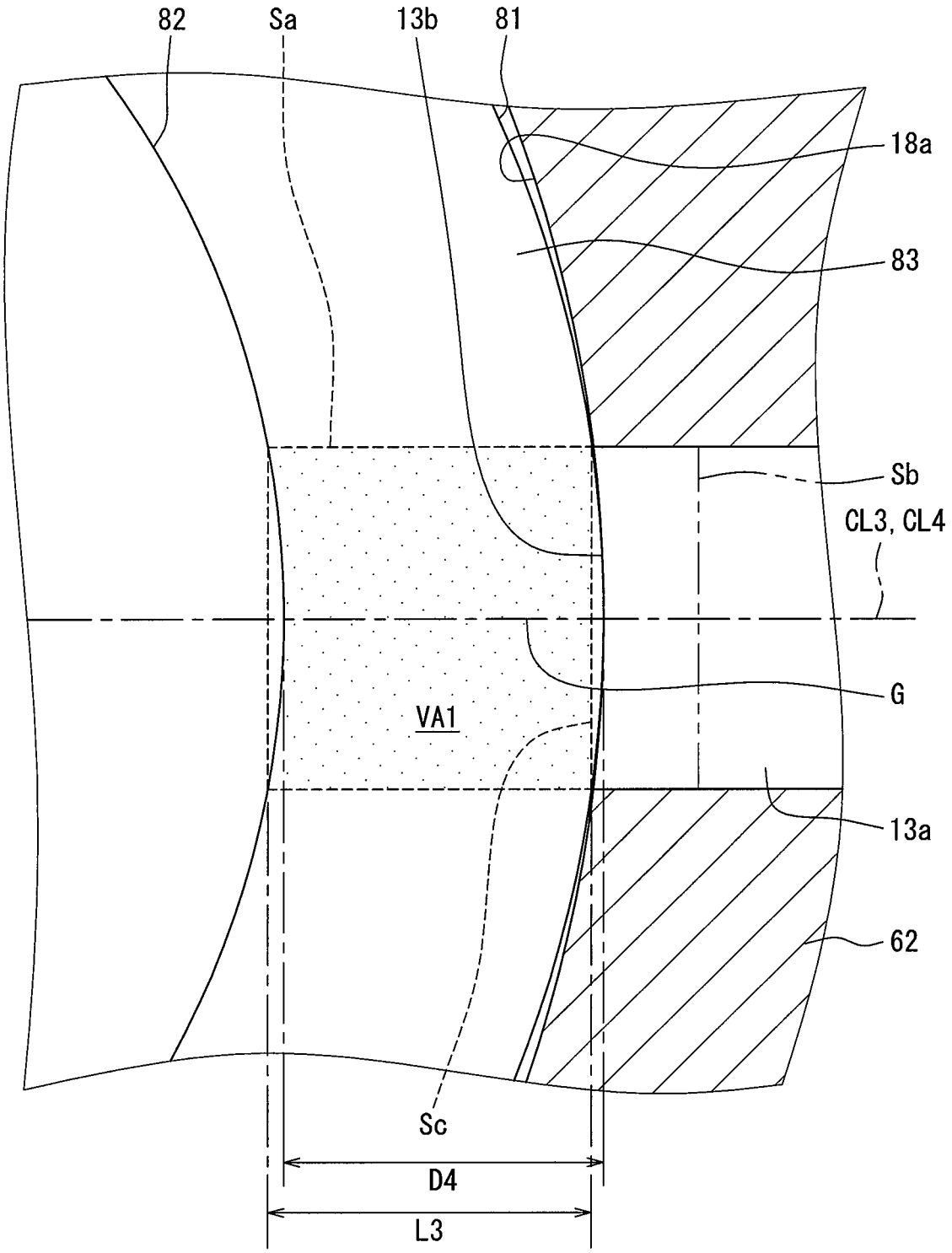
FIG. 6 is an expanded view around an extension region in FIG. 5.

As shown in FIG. 6, the length dimension L3 of the extension region VA1 in the extending direction of the center line CL3 of the low-pressure port 13*b* has a value different from the step dimension D4 of the pin stepped-surface 83 due to a difference between the outer diameter D2 of the small-diameter pin part 82 and the inner diameter D3 of the pin passage 18*a*. Specifically, the length dimension L3 of the extension region VA1 is larger than the step dimension D4 of the pin stepped-surface 83 because the inner diameter D3 of the pin passage 18*a* is larger than the outer diameter D2 of the small-diameter pin part 82.

The step dimension D4 of the pin stepped-surface 83 is set to a value such that outer circumferential area Sa as a virtual area of the outer circumferential surface of the extension region VA1 is larger than channel area Sb of the out-orifice 13*a*. In this case, the amount of flow of the fuel that can pass through the outer circumferential surface of the extension region VA1 in the in-passage gap G is larger than the amount of flow of the fuel that can pass through the out-orifice 13*a*. The exhaust amount of the fuel through the low-pressure channel 13 is therefore defined by the out-orifice 13*a* rather than the in-passage gap G. The outer circumferential area Sa of the extension region VA1 is calculated by a product of the circumferential length of the low-pressure port 13*b* and the length dimension L3 of the extension region VA1, and the channel area Sb of the out-orifice 13*a* is a cross section in the radial direction orthogonal to the center line CL4 of the out-orifice 13*a*.

The outer circumferential area Sa of the extension region VA1 is not only larger than the channel area Sb of the out-orifice 13*a*, but also larger than a value as a product of the channel area Sb of the out-orifice 13*a* and a predetermined safety coefficient. The safety coefficient includes a positive value larger than "1" such as "1.5". In the first embodiment, the safety coefficient is set to, for example, "1.5", and the step dimension D4 of the pin stepped-surface 83 is set such that the outer circumferential area Sa of the extension region VA1 has a value larger than a value 1.5 times as large as the channel area Sb of the out-orifice 13*a*.

Furthermore, the outer circumferential area Sa of the extension region VA1 is not only larger than a value on a channel area Sb of the out-orifice 13*a*, but also larger than open area Sc of the low-pressure port 13*b*. The area in a direction orthogonal to the center line CL3 of the low-pressure port 13*b* is assumed as the open area Sc. The low-pressure port 13*b* has an elliptic shape with the major axis in the axial direction of the pin passage 18*a* and the minor axis in the radial direction of the pin passage 18*a*, in which the minor axis is equal to the inner diameter D5 of the out-orifice 13*a*, while the major axis is larger than the inner diameter D5 of the out-orifice 13*a*. Hence, the open area Sc of the low-pressure port 13*b* is larger than the channel area Sb of the out-orifice 13*a*. In the first embodiment, the step dimension D4 of the pin stepped-surface 83 is set such that the outer circumferential area Sa of the extension region VA1 has a value larger than the open area Sc of the low-pressure port 13*b*, thereby the outer circumferential area Sa of the extension region VA1 is larger than the channel area Sb of the out-orifice 13*a*.

On the other hand, the step dimension D4 of the pin stepped-surface 83 has a value smaller than the inner diameter D5 of the out-orifice 13*a*. This reduces a possibility of insufficient strength of the small-diameter pin part 82 due to an extremely thin small-diameter pin part 82 compared with the large-diameter pin part 81. A part of the small-diameter pin part 82 penetrates in the extension region VA1 because the outer circumferential surface of the small-diameter pin part 82 and the inner circumferential surface of the pin passage 18*a* are each a curved surface.

A procedure for manufacturing the pin passage 18*a* in the valve body 10 is now described as a method of manufacturing the fuel injection valve 100.

In FIGS. 3 and 4, first, a through-hole is formed in the valve plate 62 to form the pin passage 18*a* and the control valve chest 15. Subsequently, fluid polishing is performed on the low-pressure channel 13 in such a manner that a liquid containing a medium such as an abrasive or a polishing stone is caused to flow from the low-pressure port 13*b* to the low-pressure channel 13 to smooth the inner circumferential surface of the low-pressure channel 13 such that the amount of flow of the fuel flowing through the low-pressure channel 13 has a target value such as a designed value. Subsequently, sliding surface processing is performed on the pin passage 18*a* to smooth the inner circumferential surface of the pin passage 18*a* such that friction is less likely to occur during sliding of the drive pin 27 within the pin passage 18*a*.

In the pin passage 18*a* of the first embodiment, the entire inner circumferential surface of the pin passage 18*a* is a sliding surface, and the low-pressure port 13*b* is formed in the sliding surface. As a result, if fluid polishing is performed on the low-pressure channel 13 after sliding surface processing of the pin passage 18*a*, a portion around the low-pressure port 13*b* in the processed sliding surface is supposed to be subjected to fluid polishing. In such a case, smoothness of the portion around the low-pressure port 13*b* is different from smoothness of other sliding surface in the inner circumferential surface of the pin passage 18*a*, and thus slidability of the drive pin 27 in the pin passage 18*a* may not agree with a designed slidability. On the other hand, when sliding surface processing of the pin passage 18*a* is performed after the fluid polishing of the low-pressure channel 13 as in the first embodiment, even if part of the inner circumferential surface of the pin passage 18*a* has been subjected to fluid polishing, the entire pin passage 18*a* has uniform smoothness through subsequent sliding surface processing. As a result, slidability of the drive pin 27 in the pin passage 18*a* is allowed to agree with the designed slidability.

According to the first embodiment as described hereinbefore, since the step dimension D4 of the pin stepped-surface 83 is appropriately large, it is possible to suppress excessive approach of the small-diameter pin part 82 to the low-pressure port 13*b*, causing the amount of flow of the fuel in the low-pressure channel 13 to be defined by the in-passage gap G rather than the out-orifice 13*a*. In such a case, even if the drive pin 27 is axially deviated from the pin passage 18*a*, the exhaust amount of the fuel through the low-pressure channel 13 is defined only by the out-orifice 13*a*; hence, the exhaust amount is less likely to vary. Consequently, when the control valve 30 is in the first state, time required for reducing the pressure in the pressure control chamber 12 is less likely to vary. As a result, it is possible to suppress unintended variations in the injection amount of the fuel from the injection holes 50.

According to the first embodiment, the step dimension D4 of the pin stepped-surface 83 is set such that the outer circumferential area Sa of the extension region VA1 is larger than the channel area Sb of the out-orifice 13*a* in the in-passage gap G. It is therefore possible to achieve a configuration where the exhaust amount of the fuel through the low-pressure channel 13 is defined by the out-orifice 13*a* rather than the in-passage gap G.

It is supposed that the amount of the fuel that actually flows into the extension region VA1 in the in-passage gap G is smaller than the estimated amount because the fuel flow is obstructed by the portion of the small-diameter pin part 82 that penetrates in the extension region VA1. With regard to this, in the first embodiment, the outer circumferential area Sa of the extension region VA1 is not only larger than the channel area Sb of the out-orifice 13*a*, but also larger than the value as a product of the channel area Sb of the out-orifice 13*a* and a safety coefficient such as "1.5". As a result, it is securely avoided that the amount of the fuel, which actually flows through the low-pressure channel 13, is defined by the in-passage gap G rather than the out-orifice 13*a*.

In the first embodiment, the virtual region as the extension of the low-pressure port 13*b* along the center line CL3 is assumed as the extension region VA1. The outer circumferential area Sa of the extension region VA1 is larger than the outer circumferential area of a virtual region as an extension of the low-pressure port 13*b* along the center line CL4 of the out-orifice 13*a* because the open area Sc of the low-pressure port 13*b* is larger than the channel area Sb of the out-orifice 13*a*. The step dimension D4 of the pin stepped-surface 83 is set such that the outer circumferential area Sa of the extension region VA1 has a value larger than the open area Sc of the low-pressure port 13*b*. It is therefore possible to achieve a configuration where the outer circumferential area Sa of the extension region VA1 is larger than the open area Sc of the out-orifice 13*a*.

In the first embodiment, the entire inner circumferential surface of the pin passage 18*a* extends straightly in the axial direction, making it possible to facilitate operation of forming the pin passage 18*a* in the valve plate 62. In addition, it is possible to form a state where the outer circumferential end of the pin stepped-surface 83 constantly slides on the inner circumferential surface of the pin passage 18*a*. Hence, sliding speed of the drive pin 27 can be stabilized in the pin passage 18*a* compared with a configuration where the pin stepped-surface 83 moves in and out through the injection-hole-side end portion of the pin passage 18*a*, for example. In such a case, operation speed of the control valve 30 pressed by the drive pin 27 is also stabilized, which makes it possible to suppress a variation in the amount of the fuel exhausted through the low-pressure channel 13 from the control valve chest 15.

In the first embodiment, since the small-diameter pin part 82 is shorter than the large-diameter pin part 81, strength of the drive pin 27 as a whole can be increased compared with a configuration where the small-diameter pin part 82 is longer than the large-diameter pin part 81, for example. In addition, since the length dimension L2 of the small-diameter pin part 82 is smaller than the outer diameter D1 of the large-diameter pin part 81, strength of the drive pin 27 as a whole can be increased compared with a configuration where the length dimension L2 of the small-diameter pin part 82 is larger than the outer diameter D1 of the large-diameter pin part 81, for example. As described above, the length dimension L2 of the small-diameter pin part 82 is made as small as possible, thereby even if the drive pin 27 is contracted while pressing the control valve 30, the contraction level can be reduced to the utmost. This eliminates the need of increasing the displacement amount of the drive pin 27 by the contracted level of the small-diameter pin part 82. It is therefore possible to reduce waste of driving force or power consumption due to deformation loss of the small-diameter pin part 82.

In the fuel injection valve 100, the inner diameter and the outer diameter of the ceiling seat surface 15*b* are each reduced to achieve higher pressure of the fuel and higher accuracy of fuel injection amount control, which reduces a fuel pressure load applied to the control valve 30 against the driving force of the drive part 20. On the other hand, open area at the downstream end portion of the high-pressure channel 17 and the outer diameter of the lower valve seat surface 71*b* need to each be increased in order to increase the transfer speed during transfer of the control valve 30 from the second state to the first state, leading to an increase in size of the control valve 30. However, if the drive pin 27 is thinned, stiffness of the drive pin 27 is reduced, and thus the drive pin 27 is easily compressed and deformed during pressing of the upsized control valve 30, so that deformation loss occurs in the drive pin 27, leading to a need of increasing the displacement amount of the drive pin 27. In other words, this leads to waste of driving force to displace the control valve 30 by the drive pin 27.

With regard to this, the inventors have got the following finding. That is, in a configuration where the drive pin 27 has both the large-diameter pin part 81 and the small-diameter pin part 82, the large-diameter pin part 81 can be thickened compared with a configuration where the entire drive pin 27 is thinned, for example. According to such a finding, even if the small-diameter pin part 82 is thinned, the large-diameter pin part 81 can be thickened, and the small-diameter pin part 82 can be shortened as much as possible, thereby strength of the drive pin 27 as a whole can be appropriately maintained compared with a configuration where the entire drive pin 27 is thinned, for example.

In the first embodiment, one end portion of the drive pin 27 is formed by the large-diameter pin part 81, and the other end portion thereof is formed by the small-diameter pin part 82. This leads to suppression of occurrence of an event where when an operator inserts the drive pin 27 into the pin passage 18*a* of the valve plate 62 during manufacturing of the fuel injection valve 100, the operator mounts the drive pin 27 in the valve plate 62 while turning the large-diameter pin part 81 to the injection hole side by mistake. Even if the drive pin 27 is inserted into the pin passage 18*a* in an opposite direction, the fuel injection valve 100 is completed in such a manner that the large-diameter pin part 81 is opposed to the low-pressure port 13*b* in the pin passage 18*a*, leading to an excessively small clearance between the large-diameter pin part 81 and the low-pressure port 13*b*. If the fuel injection valve 100 is operated in this state, since the exhaust amount of the fuel through the low-pressure channel 13 is defined by the gap between the large-diameter pin part 81 and the inner circumferential surface of the pin passage 18*a* rather than the out orifice 13*a*, the injection amount of the fuel from the injection holes 50 is excessively small. Hence, the control unit 5 or the like performs determination processing on whether fuel injection amount is excessively small, which makes it possible to detect a fuel injection valve 100 in which the drive pin 27 is oppositely inserted in the pin passage 18*a*.

Second Embodiment

In a configuration of a second embodiment, the low-pressure channel 13 is expanded on an upstream side with respect to the out-orifice 13*a*. The second embodiment is described mainly on differences from the first embodiment.

Figure 7:
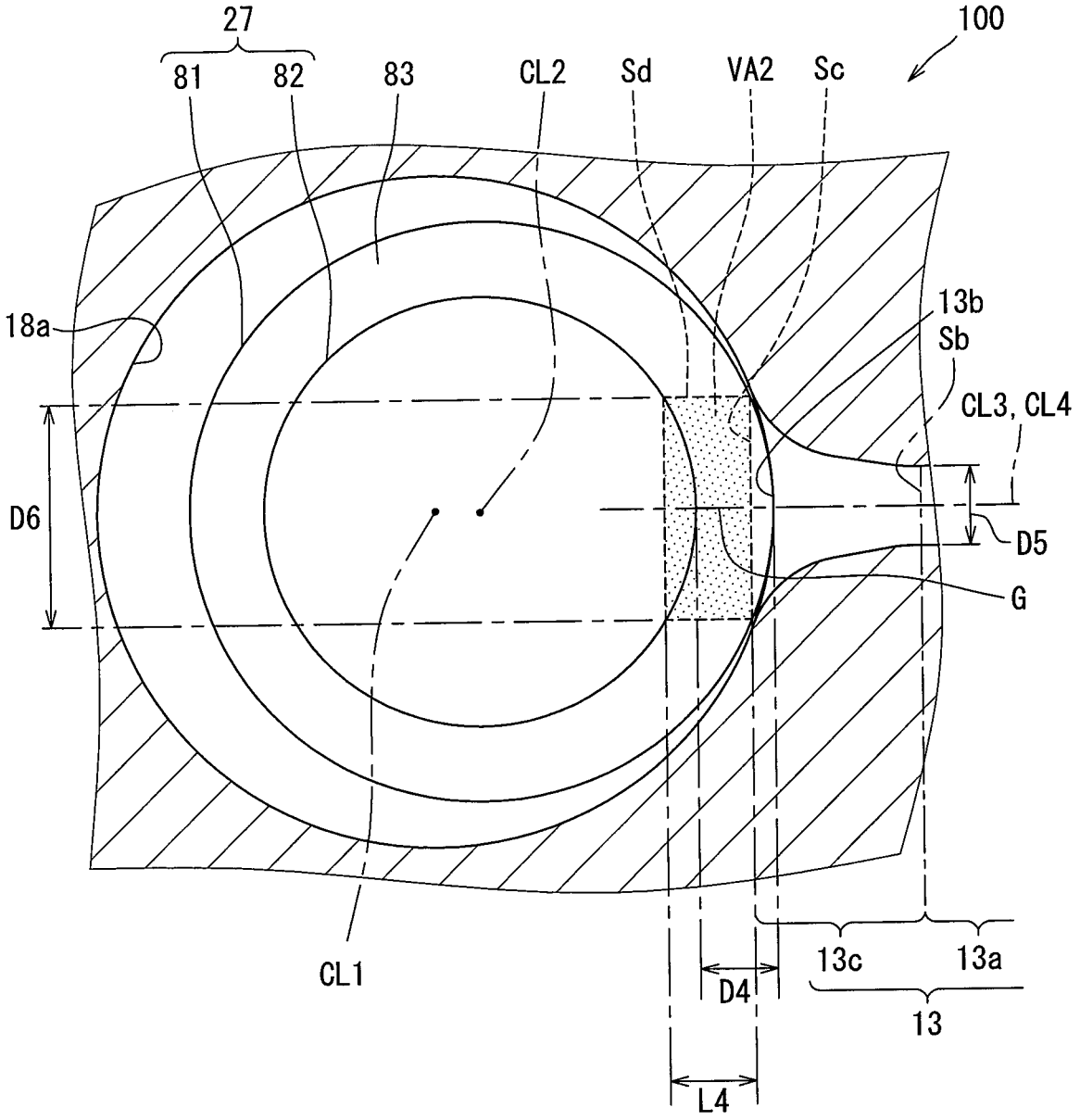
FIG. 7 is a cross-sectional view of a fuel injection valve illustrating a configuration around a low-pressure port in a second embodiment.

As shown in FIG. 7, the low-pressure channel 13 has an expanding path 13*c* that expands the low-pressure channel 13 toward the low-pressure port 13*b*. The expanding path 13*c* extends from the out-orifice 13*a* toward the upstream side in the low-pressure channel 13, and forms the low-pressure port 13*b* by its upstream end portion. The center line of the expanding path 13*c* coincides with the center line CL4 of the out-orifice 13*a*. The channel area of the expanding path 13*c* gradually increases as closer to the low-pressure port 13*b*, and the inner circumferential surface of the expanding path 13*c* has a curved surface expanded toward the inner circumferential side. The expanding path 13*c* has a smallest channel area at the boundary with the out-orifice 13*a* and a largest channel area at the low-pressure port 13*b*. The inner circumferential surface of the expanding path 13*c* may have a tapered surface.

In the valve plate 62, the low-pressure channel 13 is formed by a hole extending in a direction crossing the thickness direction of the valve plate 62. Specifically, the expanding path 13*c* is configured such that an original hole shape is gradually expanded as closer to the low-pressure port 13*b*, and such a hole is subjected to fluid polishing as in the first embodiment to form the expanding path 13*c*.

The expanding path 13*c* may be configured such that the original hole has a straight shape having a uniform inner diameter, and the hole is subjected to fluid polishing so that the expanding path 13*c* is formed so as to be gradually expanded as closer to the low-pressure port 13*b*. The entire expanding path 13*c* may have a uniform inner diameter so that a stepped surface is formed at a boundary between the expanding path 13*c* and the out-orifice 13*a*. In such a configuration, the low-pressure channel 13 is also expanded on an upstream side with respect to the out-orifice 13*a*.

In the second embodiment, when the small-diameter pin part 82 is closest to the low-pressure port 13*b*, a virtual region is assumed as an extension of the low-pressure port 13*b*, which corresponds to an upstream end portion of the expanding path 13*c*, up to the small-diameter pin part 82 in the radial direction of the pin passage 18*a*, and is referred to as an expansion region VA2. The expansion region VA2 has a columnar shape extending along the center line CL3 of the low-pressure port 13*b* as with the extension region VA1 of the first embodiment, but has the major axis and the minor axis that are each larger than that of the extension region VA1. This causes the length dimension L4 of the expansion region VA2 to be larger than the length dimension L3 of the extension region VA1 in the radial direction of the pin passage 18*a*. The expansion region VA2 corresponds to "outlet region".

With the step dimension D4 of the pin stepped-surface 83, the outer circumferential area Sd of the expansion region VA2 is set to a value larger than each of the channel area Sb of the out-orifice 13*a* and the open area Sc of the low-pressure port 13*b*. In such a case, as with the extension region VA1 of the first embodiment, the amount of the fuel that can pass through the outer circumferential surface of the expansion region VA2 is larger than the amount of flow of the fuel that can pass through the out-orifice 13*a*. The outer circumferential area Sd of the expansion region VA2 is not only larger than each of the channel area Sb of the out-orifice 13*a* and the open area Sc of the low-pressure port 13*b*, but also larger than a value as a product of the channel area Sb or the open area Sc and the same safety coefficient as that in the first embodiment.

On the other hand, the step dimension D4 of the pin stepped-surface 83 has a value smaller than each of the inner diameter D5 of the out-orifice 13*a* and the minor axis D6 of the low-pressure port 13*b*. This reduces a possibility of insufficient strength of the small-diameter pin part 82 due to an extremely thin small-diameter pin part 82, as in the first embodiment.

In the second embodiment, the outer circumferential area Sd of the expansion region VA2 is larger than the open area Sc of the low-pressure port 13*b* and thus larger than the channel area Sb of the out-orifice 13*a*. It is therefore possible to achieve a configuration that prevents the exhaust amount of the fuel through the low-pressure channel 13 from being defined by the in-passage gap G.

Third Embodiment

Although the entire inner circumferential surface of the pin passage 18*a* extends straightly in the axial direction in the first embodiment, the inner circumferential surface of the pin passage 18*a* has a step in the third embodiment. The third embodiment is described mainly on differences from the first embodiment.

Figure 8:
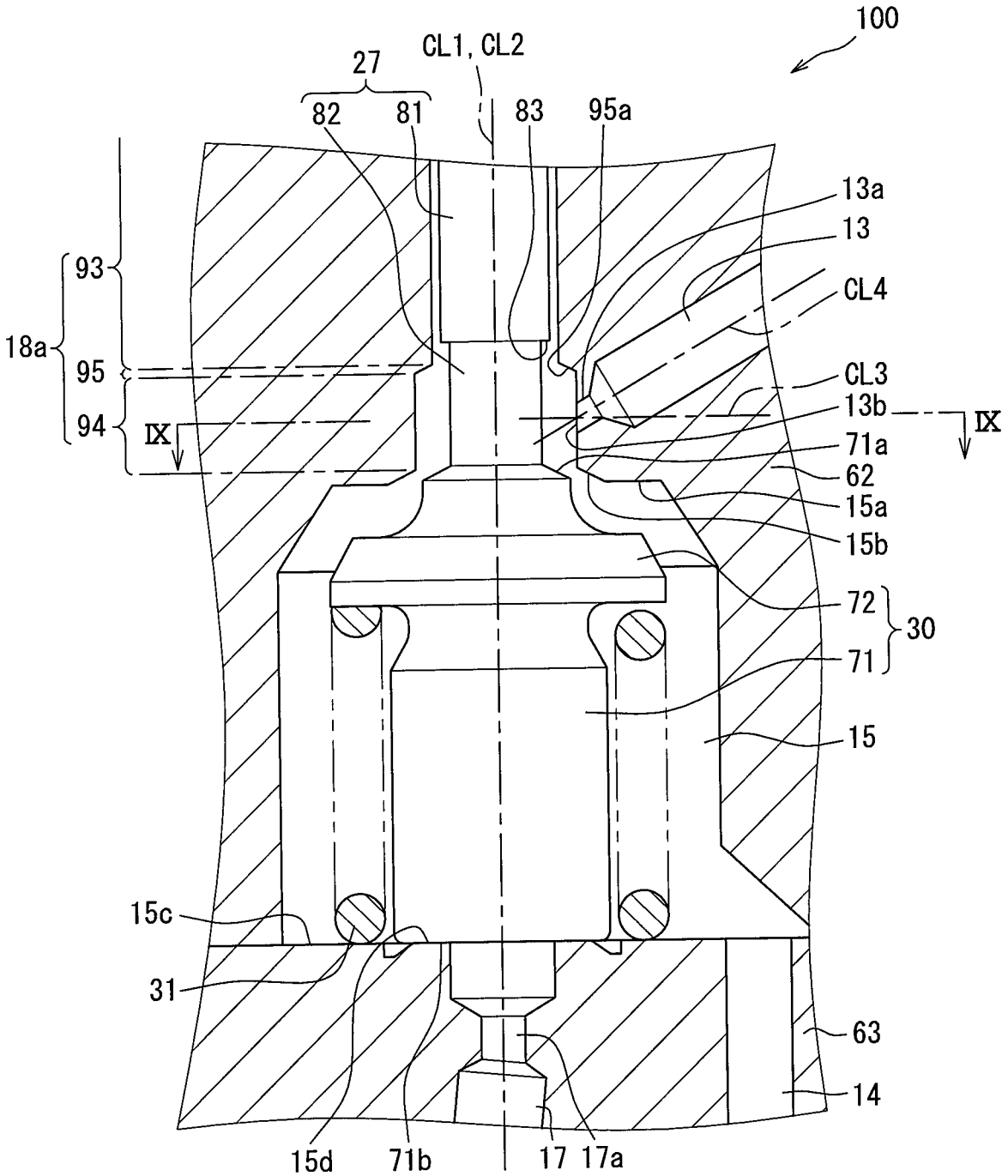
FIG. 8 is a longitudinal sectional view of a fuel injection valve illustrating a configuration around a control valve in a third embodiment.

As shown in FIG. 8, the pin passage 18*a* includes a small-diameter passage part 93, a large-diameter passage part 94, and a stepped passage part 95. The small-diameter passage part 93 extends straightly from the counter-injection-hole-side end portion of the pin passage 18*a* toward the injection hole side. The large-diameter passage part 94 has an inner diameter larger than that of the small-diameter passage part 93, and extends straightly from the injection-hole-side end portion of the pin passage 18*a* toward the counter-injection-hole-side. The injection-hole-side end portion of the large-diameter passage part 94 forms the injection-hole-side end portion of the pin passage 18*a*, and the inner diameter of the ceiling seat surface 15*b* is equal to the inner diameter of the large-diameter passage part 94.

In the pin passage 18*a*, the inner circumferential surface of the small-diameter passage part 93 forms the sliding surface on which the drive pin 27 slides while the inner circumferential surface of the large-diameter passage part 94 does not form the sliding surface. Hence, sliding surface processing is performed on the inner circumferential surface of the small-diameter passage part 93 but is not performed on the inner circumferential surface of the large-diameter passage part 94. The small-diameter passage part 93 corresponds to "first passage part", and the large-diameter passage part 94 corresponds to "second passage part" including an expanded pin passage 18*a* compared with the small-diameter passage part 93. The large-diameter passage part 94 may be referred to as an expanded passage part.

The stepped passage part 95 has a passage stepped-surface 95*a* that faces the injection hole side while being inclined with respect to the axial direction of the pin passage 18*a*, and connects the small-diameter passage part 93 to the large-diameter passage part 94. The valve plate 62 has a recess formed by depressing the inner circumferential surface of the pin passage 18*a* to the outer circumferential side, and the recess forms the large-diameter passage part 94 and the stepped passage part 95. The recess is opened to the control valve chest 15, thereby the large-diameter passage part 94 is in communication with the control valve chest 15.

Figure 9:
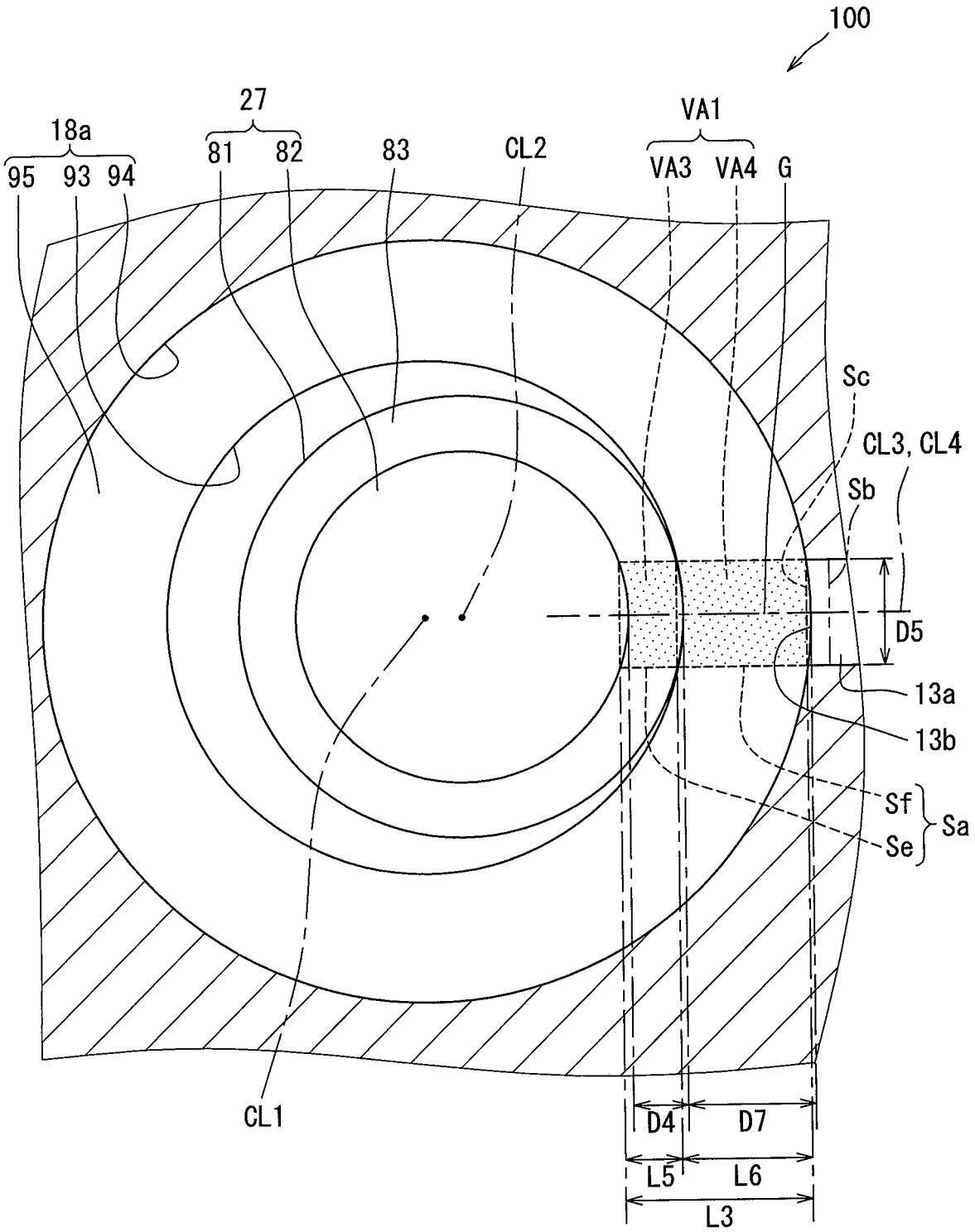
FIG. 9 is a sectional view along a line IX-IX, illustrating a configuration around a low-pressure port.

In the pin passage 18*a*, the low-pressure port 13*b* is formed in the inner circumferential surface of the large-diameter passage part 94. The length dimension of the large-diameter passage part 94 is smaller than the length dimension of the small-diameter passage part 93 but larger than the length dimension L2 (see FIG. 4) of the small-diameter pin part 82 of the drive pin 27 in the axial direction of the pin passage 18*a*. The injection-hole-side end portion of the large-diameter pin part 81 and the pin stepped-surface 83 are constantly disposed on the injection hole side with respect to the stepped passage part 95 regardless of displacement of the drive pin 27. As shown in FIG. 9, the step dimension D7 as a width dimension of the passage stepped-surface 95*a* is larger than the step dimension D4 of the pin stepped-surface 83 in the radial direction of the pin passage 18*a*.

A movable range of the drive pin 27 associated with drive of the drive part 20 is in a range in which the large-diameter pin part 81 does not protrude from the small-diameter passage part 93 to the injection hole side. In such a case, the pin stepped-surface 83 of the drive pin 27 does not pass through the stepped passage part 95 of the pin passage 18*a* in the axial direction. For example, in a configuration where the pin stepped-surface 83 reciprocates between the injection hole side and the counter-injection-hole-side while passing through the stepped passage part 95 unlike the third embodiment, the pin stepped-surface 83 or the stepped passage part 95 may be deformed due to contact between the outer circumferential end of the pin stepped-surface 83 and the inner circumferential end of the stepped passage part 95. On the other hand, in a configuration where the pin stepped-surface 83 does not pass through the stepped passage part 95 as in the third embodiment, it is possible to suppress deformation or damage of the outer circumferential end of the pin stepped-surface 83 or the inner circumferential end of the stepped passage part 95.

In the low-pressure channel 13 of the third embodiment, as in the first embodiment, the low-pressure port 13*b* is formed by the upstream end portion of the out-orifice 13*a*, and a virtual region as an extension from the low-pressure port 13*b* in the radial direction is referred to as an extension region VA1.

As shown in FIG. 9, the extension region VA1 has an inside region VA3 disposed on a side close to the small-diameter pin part 82, and an outside region VA4 disposed on a side outer than the inside region VA3. The inside region VA3 is disposed on a side inner than the inner circumferential surface of the small-diameter passage part 93 while being in line with the pin stepped-surface 83 in the axial direction of the pin passage 18*a*, and is located at a position separate from the pin stepped-surface 83 on the injection hole side. The outside region VA4 is in line with the passage stepped-surface 95*a* in the axial direction of the pin passage 18*a*, and is located at a position separate from the passage stepped-surface 95*a* on the injection hole side. The length dimension L5 of the inside region VA3 is smaller than the length dimension L6 of the outside region VA4 but larger than the step dimension D4 of the pin stepped-surface 83 in the radial direction of the pin passage 18*a*. The length dimension L6 of the outside region VA4 is larger than the step dimension D7 of the passage stepped-surface 95*a*.

The inside region VA3 and the outside region VA4 each have a cylindrical shape extending in the radial direction, and are disposed so as to divide the extension region VA1 in two in the radial direction. The outer circumferential area Sa of the extension region VA1 corresponds to the sum of the outer circumferential area Se of the inside region VA3 and the outer circumferential area Sf of the outside region VA4. The inside region VA3 corresponds to "in-depression region".

The step dimension D4 of the pin stepped-surface 83 is set to a value such that the outer circumferential area Sa of the extension region VA1 is larger than the channel area Sb of the out-orifice 13*a*. Not only the outer circumferential area Sa of the extension region VA1 but also only the outer circumferential area Se of the inside region VA3 is larger than the channel area Sb of the out-orifice 13*a*. Furthermore, the outer circumferential area Se of the inside region VA3 is not only larger than the channel area Sb of the out-orifice 13*a* but also larger than a value as a product of the channel area Sb and the same safety coefficient as that in the first embodiment. On the other hand, the step dimension D4 of the pin stepped-surface 83 has a value smaller than the step dimension D7 of the passage stepped-surface 95*a*.

In the third embodiment, in the configuration where the extension region VA1 includes both the inside region VA3 and the outside region VA4, the outer circumferential area Se of the inside region VA3 is larger than the open area Sc of the low-pressure port 13*b*. As a result, the outer circumferential area Sa of the extension region VA1 is securely larger than the open area Sc of the low-pressure port 13*b*. Hence, the exhaust amount of the fuel through the low-pressure channel 13 is securely prevented from being defined by the in-passage gap G.

In the third embodiment, the channel area Sb of the out-orifice 13*a* is smaller than the open area Sc of the low-pressure port 13*b* due to the low-pressure channel 13 inclined with respect to the radial direction. Hence, the outer circumferential area Se of the inside region VA3 is larger than the open area Sc of the low-pressure port 13*b*, which means that the outer circumferential area Se of the inside region VA3 is larger than the channel area Sb of the out-orifice 13*a*. Consequently, the exhaust amount of the fuel through the low-pressure channel 13 is securely prevented from being defined by the in-passage gap G.

In the third embodiment, the low-pressure port 13*b* is provided in the inner circumferential surface of the large-diameter passage part 94 having no sliding surface in the pin passage 18*a*. As a result, for example, even if fluid polishing of the low-pressure channel 13 is performed after sliding processing is performed on the inner circumferential surface of the small-diameter passage part 93, the inner circumferential surface of the small-diameter passage part 93 forming the sliding surface can be prevented from being subjected to fluid polishing. Hence, unlike the first embodiment, even if fluid polishing of the low-pressure channel 13 is performed either before or after sliding processing of the small-diameter passage part 93, it is possible to prevent smoothness of the sliding surface of the pin passage 18*a* from being changed by the fluid polishing. In this way, sliding processing of the pin passage 18*a* and fluid polishing of the low-pressure channel 13 may be performed with an appropriate operation sequence without limitation, making it possible to increase the degree of freedom of operation steps.

In the third embodiment, the large-diameter pin part 81 of the drive pin 27 does not move to the injection hole side beyond the small-diameter passage part 93 in the pin passage 18*a*. It is therefore possible to suppress deformation or damage of the outer circumferential end of the pin stepped-surface 83 or the inner circumferential end of the stepped passage part 95 due to contact between the pin stepped-surface 83 and the stepped passage part 95.

Fourth Embodiment

Although the inner diameter of the ceiling seat surface 15*b* of the control valve chest 15 is equal to the inner diameter of the large-diameter passage part 94 in the third embodiment, the inner diameter of the ceiling seat surface 15*b* is smaller than the inner diameter of the large-diameter passage part 94 in a fourth embodiment. The fourth embodiment is described mainly on differences from the third embodiment.

Figure 10:
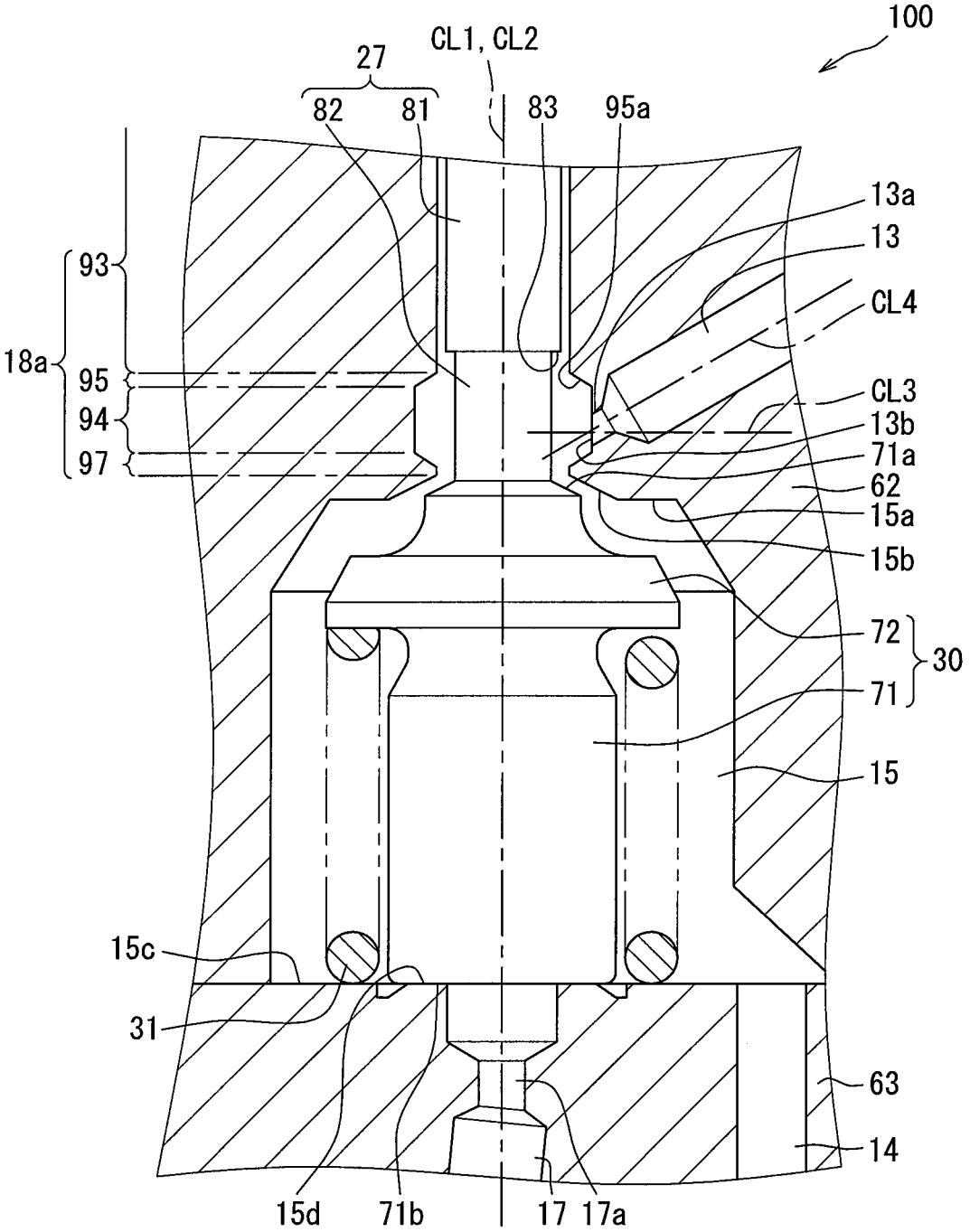
FIG. 10 is a longitudinal sectional view of a fuel injection valve, illustrating a configuration around a control valve in a fourth embodiment.

As shown in FIG. 10, the pin passage 18*a* includes a throttle passage part 97 that throttles the pin passage 18*a*, and the inner diameter of the ceiling seat surface 15*b* is equal to the smallest inner diameter of the throttle passage part 97. The throttle passage part 97 extends from the injection-hole-side end portion of the large-diameter passage part 94 toward the injection hole side, and the injection-hole-side end portion of the throttle passage part 97 corresponds to the injection-hole-side end portion of the pin passage 18*a*. The throttle passage part 97 has a portion having a throttle degree that is gradually increased as the portion is closer to the control valve chest 15. Hence, the inner diameter of the throttle passage part 97 is not uniform, and a portion having the smallest inner diameter forms an inner circumferential end of the ceiling seat surface 15*b*. The throttle passage part 97 corresponds to "third passage part".

In the fourth embodiment, as in the third embodiment, the low-pressure port 13*b* is formed in the inner circumferential surface of the large-diameter passage part 94. In such a case, the low-pressure port 13*b* is disposed on the counter-injection-hole-side with respect to the throttle passage part 97. In the fourth embodiment, unlike the third embodiment, a recess forming the large-diameter passage part 94 and the stepped passage part 95 is not opened to the control valve chest 15, and a portion that hinders opening of the recess forms the throttle passage part 97.

In the fourth embodiment, since the inner diameter of the ceiling seat surface 15*b* is made smaller than the inner diameter of the large-diameter passage part 94 by the throttle passage part 97, the diameter of the ceiling seat surface 15*b* can be reduced. The diameter of the ceiling seat surface 15*b* is reduced in this way, making it possible to reduce a fuel pressure load applied to the control valve 30 against the driving force of the drive part 20. As a result, even if pressure of the fuel injected from the injection holes 50 is increased, it is possible to suppress the difficulty: Pressure of the fuel, which is supplied from the high-pressure channel 17 into the control valve chest 15, hinders the state transfer of the control valve 30 against the driving force of the drive part 20. It is therefore possible to further increase pressure in the fuel injection valve 100.

Fifth Embodiment

Although the small-diameter pin part 82 is provided only at one end of the drive pin 27 in the first embodiment, the small-diameter pin part 82 is provided at either end of the drive pin 27 in a fifth embodiment. The fifth embodiment is described mainly on differences from the first embodiment.

Figure 11:
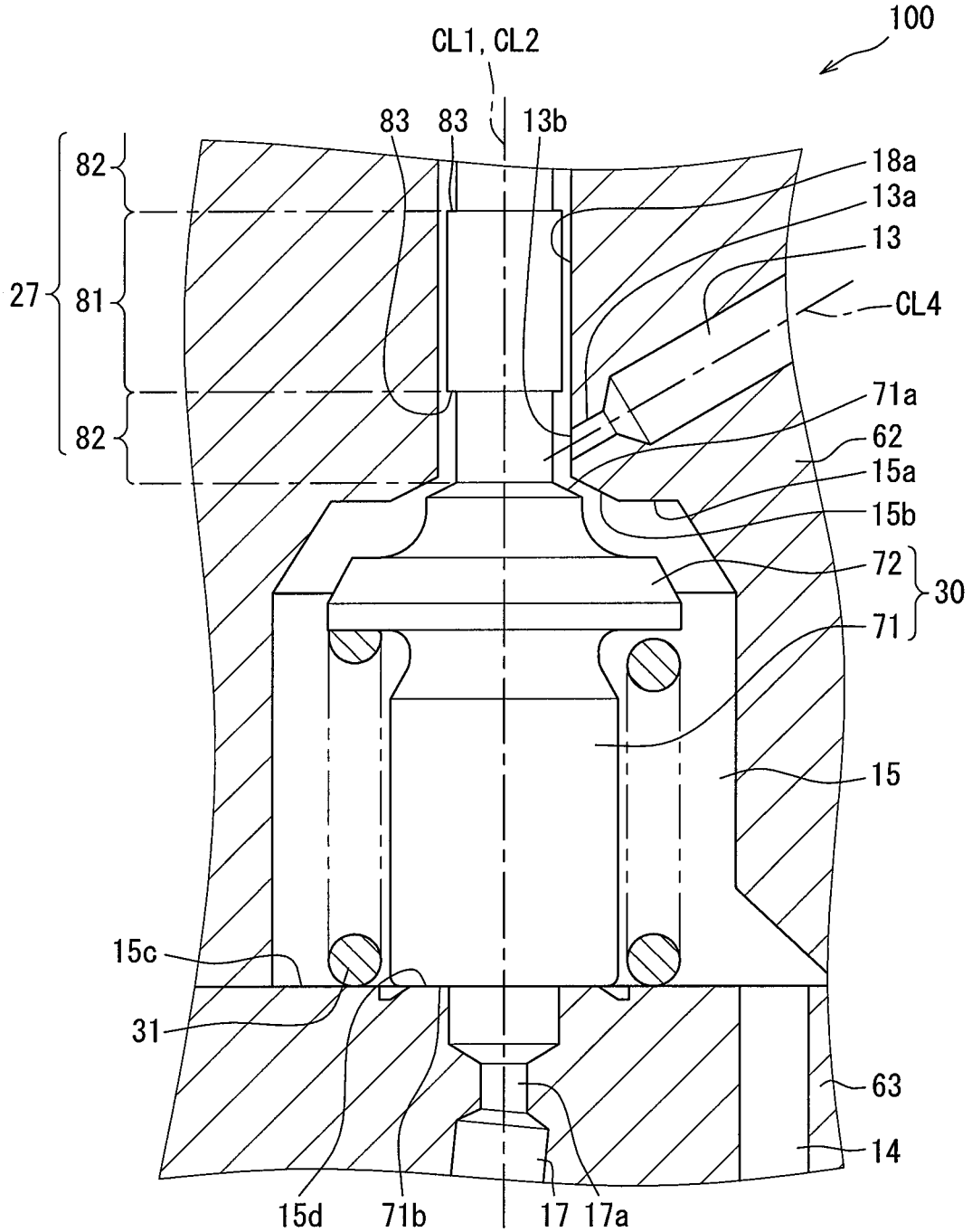
FIG. 11 is a longitudinal sectional view of a fuel injection valve, illustrating a configuration around a control valve in a fifth embodiment.

As shown in FIG. 11, in the drive pin 27, the small-diameter pin parts 82 are disposed on both the injection hole side and the counter-injection-hole-side while having the same outer diameter and the same length dimension. The pin stepped-surfaces 83 are disposed at the respective boundaries between the large-diameter pin part 81 and the small-diameter pin parts 82 while facing opposite sides.

In the fifth embodiment, since the small-diameter pin parts 82 are provided at both ends of the drive pin 27, when an operator inserts the drive pin 27 into the pin passage 18*a* during manufacturing of the fuel injection valve 100, the operator may insert the drive pin 27 in an appropriate direction without limitation. In this way, the operator is prevented from inserting the drive pin 27 in an incorrect direction, making it possible to reduce the degree of difficulty or a working load of the operation of inserting the drive pin 27 into the pin passage 18*a*.

The pair of small-diameter pin parts 82 disposed across the large-diameter pin part 81 may have different outer diameters or length dimensions. That is, the pair of pin stepped-surfaces 83 disposed on both sides of the large-diameter pin part 81 may have different step dimensions. In such a case, the pin stepped-surface 83 having a smaller step dimension between the pair of pin stepped-surfaces 83 preferably has a step dimension that is set such that the exhaust amount of the fuel through the low-pressure channel 13 is defined by the out-orifice 13*a* rather than the in-passage gap G.

Although several embodiments of the present disclosure have been described hereinbefore, the disclosure should be interpreted without being limited thereto, and can be applied to various embodiments and various combinations within the scope without departing from the gist of the disclosure. Modifications of the above embodiments will be described.

In a first modification, the outer circumferential area Sa of the extension region VA1 may be smaller than the open area Sc of the low-pressure port 13*b* as long as it is larger than the channel area Sb of the out-orifice 13*a* in the first embodiment.

In a second modification, the expanding path 91 of the low-pressure channel 13 may have a tapered surface in the second embodiment. For example, in a possible configuration, the inner circumferential surface of the expanding path 91 is linearly expanded toward the low-pressure port 13*b* so as to form the tapered surface.

In a third modification, an extension region as an extension of the out-orifice 13*a* may also be assumed in the configuration where the low-pressure channel 13 has the expanding path 91 as in the second embodiment. In such a case, the step dimension D4 of the drive pin 27 is set such that the outer circumferential area of the extension region is smaller than the channel area Sb of the out-orifice 13*a*, thereby the amount of flow of the fuel in the low-pressure channel 13 can be defined by the out-orifice 13*a* rather than by the in-passage gap G.

In a fourth modification, the pin stepped-surface 83 of the drive pin 27 may be disposed such that an area near the injection hole side with respect to the stepped passage part 95 is the movable range in the third embodiment. In such a configuration, even if the drive pin 27 moves, the pin stepped-surface 83 does not pass through the stepped passage part 95 in the axial direction. It is therefore possible to suppress deformation or the like of the pin stepped-surface 83 and the stepped passage part 95.

In a fifth modification, the step dimension D4 of the pin stepped-surface 83 of the drive pin 27 may be larger than the step dimension D7 of the stepped passage part 95 of the pin passage 18*a* in the third embodiment.

In a sixth modification, the pin stepped-surface 83 may be inclined with respect to the radial direction of the drive pin 27 in each of the above-described embodiments. In such a case, the pin stepped-surface 83 faces the injection hole side while being inclined with respect to the axial direction.

In a seventh modification, the pressing part such as the drive pin 27 is not necessarily a pin member as long as it extends in a displacement direction as the axial direction in each of the above-described embodiments. For example, in a possible configuration, the pressing part is generally formed in a rectangular columnar shape. In this configuration, the abutment part such as the large-diameter pin part 81 and the depressed opposite part such as the small-diameter pin part 82 are each formed in a rectangular columnar shape, and the depressed opposite part is thinner than the abutment part.

In an eighth modification, the abutment part such as the large-diameter pin part 81 and the depressed opposite part such as the small-diameter pin part 82 each do not necessarily have a cylindrical shape in each of the above-described embodiments. For example, in a possible configuration, the drive pin 27 generally formed in a cylindrical shape has a recess depressed toward the inner circumferential side in a circumferential portion of the drive pin 27, and the recess forms the depressed opposite part, and the remaining undepressed portion forms the abutment part. In this configuration, the pin stepped-surface 83 does not have a circular shape, and is provided in a circumferential portion in correspondence to the depressed opposite part. In this configuration, the drive pin 27 is preferably provided so as not to rotate relative to the pin passage 18*a* such that the depressed opposite part is constantly opposed to the low-pressure port 13*b*.

In a ninth modification, the drive pin 27, the sliding part 23, and the control valve 30 may be joined to one another in abutment portions by an adhesive, welding, and the like in each of the above-described embodiments. In such a case, axial deviation of the drive pin 27 may occur along with axial deviation of the sliding part 23 or the control valve 30. Hence, the step dimension D4 of the pin stepped-surface 83 is preferably set to an appropriate value such that the amount of flow of the fuel in the low-pressure channel 13 is defined by the in-passage gap G of the pin stepped-surface 83.

Figure 12:
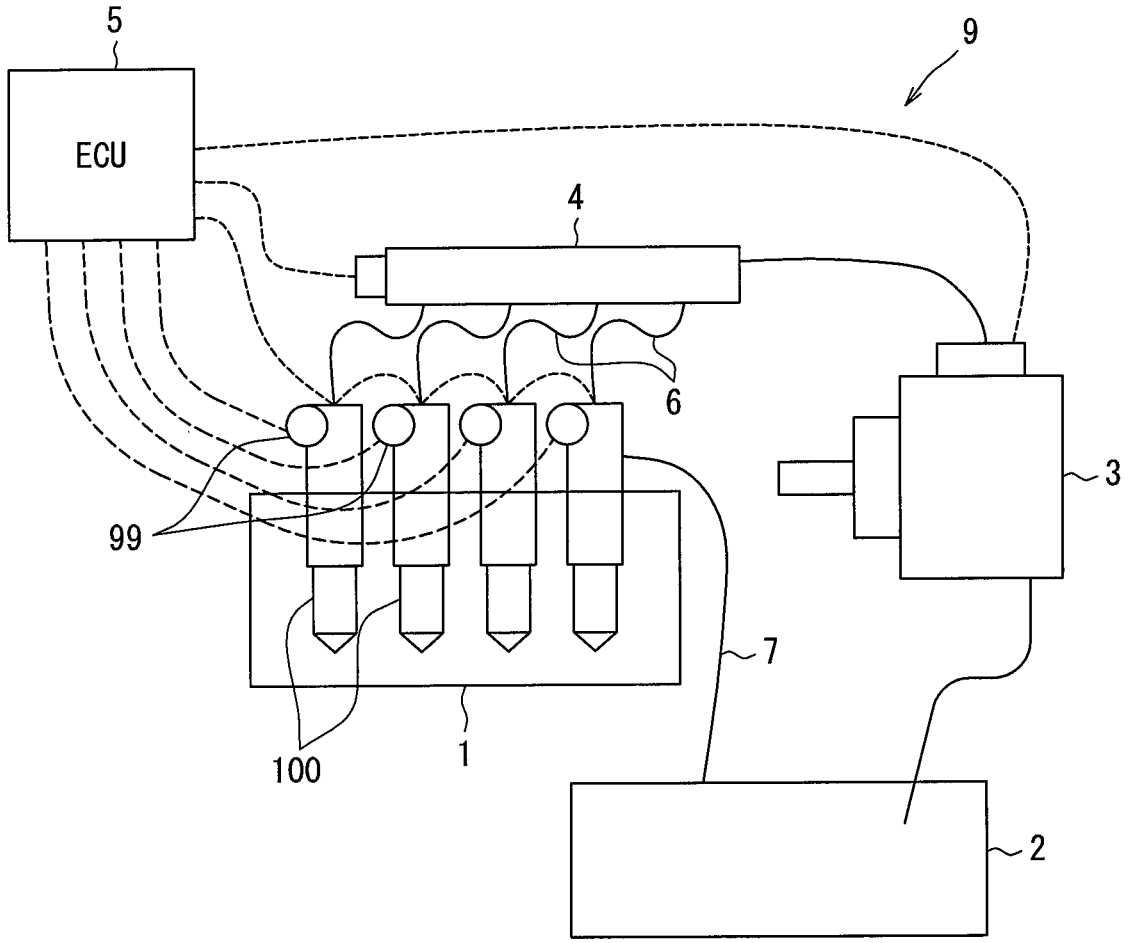
FIG. 12 is a schematic view illustrating a configuration of a fuel supply system of a ninth modification.

In a tenth modification, as shown in FIG. 12, a fuel pressure sensor 99 that detects fuel pressure in the fuel injection valve 100 may be included in the fuel supply system 9 in each of the above-described embodiments. For example, in a possible configuration, the fuel pressure sensor 99 is attached to each of the fuel injection valves 100. In this configuration, each fuel pressure sensor 99 is electrically connected to the control unit 5, and outputs a detection signal to the control unit 5.

In an eleventh modification, the fuel injection valve 100 may be mounted in an internal combustion engine 1 other than the diesel engine, such as an Otto cycle engine and a gasoline engine.

Characteristics of the fuel injection device 100 of the above embodiments can be described as follows.

A fuel injection device 100 for injecting fuel through an injection hole 50, includes a control chamber 12 that fuel flows out from or flows into, an injection hole valve element 40 that opens or closes the injection hole 50 due to a change of fuel pressure in the control chamber 12 made by the fuel flowing out from or flowing into the control chamber 12, a valve chest 15 that is connected to the control chamber 12 through a control chamber channel 14, an exhaust channel 13 which is connected to the valve chest 15 and through which to discharge fuel from the valve chest 15, an exhaust throttle part 13*a* of the exhaust channel 13 throttling the exhaust channel 13 to limit a flow rate of fuel flowing through the exhaust channel 13, a control valve 30 that is displaced in the valve chest 15 to open or close the exhaust channel 13, a pressing part 27 that extends in a displacement direction in which the control valve 30 is displaced and that moves in the displacement direction to press the control valve 30, and a pressing passage 18*a* which connects together the valve chest 15 and the exhaust channel 13 and through which the pressing part 27 is inserted. An exhaust port 13*b*, which is an upstream end portion of the exhaust channel 13, is provided on an inner peripheral surface of the pressing passage 18*a*. The pressing part 27 includes an abutment part 81 capable of being in contact with the inner peripheral surface of the pressing passage 18*a*, and a depressed opposite part 82 that is opposed to the exhaust port 13*b* at a position away from the exhaust port 13*b* in a perpendicular direction perpendicular to the displacement direction due to an outer peripheral surface of the pressing part 27 recessed from the abutment part 81 even when the abutment part 81 is in contact with the inner peripheral surface of the pressing passage 18*a*. When the abutment part 81 is in contact with the inner peripheral surface of the pressing passage 18*a*, a depression dimension D4 of the depressed opposite part 82 relative to the abutment part 81 is set, such that an amount of fuel discharged from the valve chest 15 is defined by the exhaust throttle part 13*a* instead of a gap G between the depressed opposite part 82 and the inner peripheral surface of the pressing passage 18*a*.

According to the above-described aspect, since the depressed opposite part has an appropriately large depression dimension in the pressing part, it is restricted that the depressed opposite part excessively approaches the exhaust port. It is therefore possible to suppress the difficulty: a gap between the depressed opposite part and the inner peripheral surface of the pressing passage defines the amount of fuel discharged from the valve chest to the exhaust port. In this way, the amount of fuel discharged from the exhaust port is constantly defined by the exhaust throttle part. Hence, even if the pressing part is axially deviated in the perpendicular direction in the pressing passage, time for reducing pressure in the control chamber is less likely to vary. It is therefore possible to suppress an unintentional variation in the fuel injection amount from the injection hole.

A virtual region obtained by extending the exhaust port 13*b* to the depressed opposite part 82 in the perpendicular direction includes a throttle region VA1 that exists between the exhaust port 13*b* and the depressed opposite part 82. The depression dimension D4 is set such that a virtual area Sa of an outer peripheral surface of the throttle region VA1 extending along a circumferential edge portion of the exhaust throttle part 13*a* is larger than a channel area Sb of the exhaust throttle part 13*a* in a state where the abutment part 81 is in contact with the inner peripheral surface of the pressing passage 18*a*.

The depression dimension D4 is set such that the virtual area Sa is larger than a value obtained by multiplying the channel area Sb of the exhaust throttle part 13*a* by a predetermined safety coefficient larger than 1.

An outlet region VA1, VA2 is a virtual region obtained by extending the exhaust port 13*b* to the depressed opposite part 82 in the perpendicular direction. The depression dimension D4 is set such that a virtual area Sa, Sd of an outer peripheral surface of the outlet region VA1, VA2 extending along a circumferential edge portion of the exhaust port 13*b* is larger than an open area Sc of the exhaust port 13*b* in a state where the abutment part 81 is in contact with the inner peripheral surface of the pressing passage 18*a*.

The exhaust channel 13 includes an expanding path 13*c* that is provided on an upstream side of the exhaust throttle part 13*a* to form the exhaust port 13*b* and that expands the exhaust channel 13 gradually from the exhaust throttle part 13*a* toward the exhaust port 13*b*.

The outlet region VA1, VA2 includes an in-depression region VA3, which is a region between an outer peripheral surface of the abutment part 81 and an outer peripheral surface of the depressed opposite part 82 in the perpendicular direction. The depression dimension D4 is set such that a virtual area Se of an outer peripheral surface of the in-depression region VA3 extending along the circumferential edge portion of the exhaust port 13*b* is larger than the open area Sc of the exhaust port 13*b*.

The pressing passage 18*a* extends straight such that a separation distance between the depressed opposite part 82 and the exhaust port 13*b* in the perpendicular direction is equal to the depression dimension D4 when the abutment part 81 is in contact with the inner peripheral surface of the pressing passage 18*a*.

The pressing passage 18*a* includes a first passage part 93 through which the abutment part 81 is inserted, and a second passage part 94 that is provided on the valve chest 15 side of the first passage part 93 and expands the pressing passage 18*a* more than the first passage part 93 expands the pressing passage 18*a*. The exhaust port 13*b* is provided on an inner peripheral surface of the second passage part 94. A separation distance between the depressed opposite part 82 and the exhaust port 13*b* in the perpendicular direction is equal to a value obtained by adding a step dimension D7 between the first passage part 93 and the second passage part 94 in the perpendicular direction to the depression dimension D4 when the abutment part 81 is in contact with an inner circumferential surface of the first passage part 93.

The pressing passage 18*a* includes a third passage part 97 that is provided on the valve chest 15 side of the second passage part 94 and that contracts the pressing passage 18*a* more than the second passage part 94 contracts the pressing passage 18*a* to form an end portion of the pressing passage 18*a* on the valve chest 15 side.

Despite a displacement of the pressing part 27, an end portion of the abutment part 81 on the valve chest 15 side does not move toward the valve chest 15 beyond an end portion of the first passage part 93 on the valve chest 15 side in the displacement direction.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

What is claimed is:

1. A fuel injection device for injecting fuel through an injection hole, comprising:

a control chamber that fuel flows out from or flows into;

an injection hole valve element configured to open or close the injection hole due to a change of fuel pressure in the control chamber made by the fuel flowing out from or flowing into the control chamber;

a valve chest connected to the control chamber through a control chamber channel;

an exhaust channel connected to the valve chest and through which to discharge fuel from the valve chest, an exhaust throttle part of the exhaust channel throttling the exhaust channel to limit a flow rate of fuel flowing through the exhaust channel;

a control valve displaced in the valve chest to open or close the exhaust channel;

a pressing part extending in a displacement direction in which the control valve is displaced and configured to move in the displacement direction to press the control valve; and a pressing passage connecting together the valve chest and the exhaust channel and through which the pressing part is inserted, wherein:

an exhaust port, forming an upstream end portion of the exhaust channel, is provided on an inner peripheral surface of the pressing passage;

the pressing part includes:

an abutment part capable of being in contact with the inner peripheral surface of the pressing passage;

a depressed opposite part opposing the exhaust port at a position away from the exhaust port in a perpendicular direction perpendicular to the displacement direction due to an outer peripheral surface of the pressing part recessed from the abutment part even when the abutment part is in contact with the inner peripheral surface of the pressing passage; and a pin stepped-surface arranged between the abutment part and the depressed opposite part;

when the abutment part is in contact with the inner peripheral surface of the pressing passage, a depression dimension of the depressed opposite part relative to the abutment part is set, such that an amount of fuel discharged from the valve chest is defined by the exhaust throttle part instead of a gap between the depressed opposite part and the inner peripheral surface of the pressing passage, and the pressing passage includes:

a first passage part through which the abutment part is inserted;

a second passage part provided on the valve chest side of the first passage part and expands the pressing passage more than the first passage pan expands the pressing passage; and a stepped passage part having a passage stepped-surface connecting the first and second passage parts;

the exhaust port provided on an inner peripheral surface of the second passage part;

a length dimension of the depressed opposite part is larger than an outer diameter of the depressed opposite part;

a step dimension as a width dimension of the passage stepped-surface is larger than a depression dimension of the pin stepped-surface in the radial direction of the pressing passage; and the depression dimension of the pin stepped-surface is set to a value such that an outer circumferential area of an extension region is larger than a channel area of the exhaust throttle part, when the outer circumferential area of the extension region corresponds to the sum of an outer circumferential area of the inside region and the outer circumferential area of the outside region.

2. The fuel injection device according to claim 1, wherein the depression dimension is set such that the virtual area is larger than a value obtained by multiplying the channel area of the exhaust throttle part by a predetermined safety coefficient larger than 1.

3. The fuel injection device according to claim 1, wherein:

an outlet region is a virtual region obtained by extending the exhaust port to the depressed opposite part in the perpendicular direction; and the depression dimension is set such that a virtual area of an outer peripheral surface of the outlet region extending along a circumferential edge portion of the exhaust port is larger than an open area of the exhaust port in a state where the abutment part is in contact with the inner peripheral surface of the pressing passage.

4. The fuel injection device according to claim 3, wherein the exhaust channel includes an expanding path provided on an upstream side of the exhaust throttle part to form the exhaust port and expanding the exhaust channel gradually from the exhaust throttle part toward the exhaust port.

5. The fuel injection device according to claim 3, wherein:

the outlet region includes an in-depression region, the in-depression region being a region between an outer peripheral surface of the abutment part and an outer peripheral surface of the depressed opposite part in the perpendicular direction; and the depression dimension is set such that a virtual area of an outer peripheral surface of the in-depression region extending along the circumferential edge portion of the exhaust port is larger than the open area of the exhaust port.

6. The fuel injection device according to claim 1, wherein the pressing passage extends straight such that a separation distance between the depressed opposite part and the exhaust port in the perpendicular direction is equal to the depression dimension when the abutment part is in contact with the inner peripheral surface of the pressing passage.

7. The fuel injection device according to claim 1, wherein the pressing passage includes a third passage part provided on the valve chest side of the second passage part and contracting the pressing passage more than the second passage part contracts the pressing passage to form an end portion of the pressing passage on the valve chest side.

8. The fuel injection device according to claim 1, wherein despite a displacement of the pressing part, an end portion of the abutment part on the valve chest side does not move toward the valve chest beyond an end portion of the first passage part on the valve chest side in the displacement direction.

9. The fuel injection device for injecting fuel through an injection hole according to claim 1, wherein the length dimension of the second passage part is larger than the length dimension of the depressed opposite part of the pressing part in the axial direction of the pressing passage.

10. The fuel injection device for injecting fuel through an injection hole according to claim 1, wherein the exhaust port is formed by the upstream end portion of the exhaust throttle part, and a virtual region as an extension from the exhaust port in the radial direction is the extension region, the extension region has an inside region disposed on a side close to the depressed opposite part, and an outside region disposed on a side outer than the inside region, and the length dimension of the inside region is smaller than the length dimension of the outside region but larger than the depression dimension of the pin stepped-surface in the radial direction of the pressing passage.

11. The fuel injection device for injecting fuel through an injection hole according to claim 10, wherein the length dimension of the outside region is larger than the step dimension of the passage stepped-surface.

12. The fuel injection device for injecting fuel through an injection hole according to claim 1, wherein the exhaust port is formed by the upstream end portion of the exhaust throttle part, and a virtual region as an extension from the exhaust port in the radial direction is the extension region, the extension region has an inside region disposed on a side close to the depressed opposite part, and the outside region disposed on a side outer than the inside region, and the outer circumferential area of the inside region is larger than the channel area of the exhaust throttle part.

13. A fuel injection device for injecting fuel through an injection hole, comprising:

a control chamber that fuel flows out from or flows into;

an injection hole valve element configured to open or close the injection hole due to a change of fuel pressure in the control chamber made by the fuel flowing out from or flowing into the control chamber;

a valve chest connected to the control chamber through a control chamber channel;

an exhaust channel connected to the valve chest and through which to discharge fuel from the valve chest, an exhaust throttle part of the exhaust channel throttling the exhaust channel to limit a flow rate of fuel flowing through the exhaust channel;

a control valve displaced in the valve chest to open or close the exhaust channel;

a pressing part extending in a displacement direction in which the control valve is displaced and configured to move in the displacement direction to press the control valve; and a pressing passage connecting together the valve chest and the exhaust channel and through which the pressing part is inserted, wherein:

an exhaust port, forming an upstream end portion of the exhaust channel, is provided on an inner peripheral surface of the pressing passage;

the pressing part includes:

an abutment part capable of being in contact with the inner peripheral surface of the pressing passage;

a depressed opposite part opposing the exhaust port at a position away from the exhaust port in a perpendicular direction perpendicular to the displacement direction due to an outer peripheral surface of the pressing part recessed from the abutment part even when the abutment part is in contact with the inner peripheral surface of the pressing passage; and a pin stepped-surface arranged between the abutment part and the depressed opposite part;

when the abutment part is in contact with the inner peripheral surface of the pressing passage, a depression dimension of the depressed opposite part relative to the abutment part is set, such that an amount of fuel discharged from the valve chest is defined by the exhaust throttle part instead of a gap between the depressed opposite part and the inner peripheral surface of the pressing passage, and the pressing passage includes:

a first passage part through which the abutment part is inserted;

a second passage part provided on the valve chest side of the first passage part and expands the pressing passage more than the first passage part expands the pressing passage; and a stepped passage part having a passage stepped-surface connecting the first and second passage parts;

the exhaust port provided on an inner peripheral surface of the second passage part;

a length dimension of the depressed opposite part is larger than an outer diameter of the depressed opposite part;

a step dimension as a width dimension of the passage stepped-surface has a value smaller than an inner diameter of the exhaust throttle part; and the depression dimension of the pin stepped-surface is set to a value such that an outer circumferential area of an extension region is larger than a channel area of the exhaust throttle part, when the outer circumferential area of the extension region corresponds to the sum of an outer circumferential area of the inside region and the outer circumferential area of the outside region.

14. The fuel injection device for injecting fuel through an injection hole according to claim 13, wherein the length dimension of the second passage part is larger than the length dimension of the depressed opposite part of the pressing part in the axial direction of the pressing passage.

15. The fuel injection device for injecting fuel through an injection hole according to claim 13, wherein the step dimension as the width dimension of the passage stepped-surface is larger than the step dimension of the pin stepped-surface in the radial direction of the pressing passage.

16. The fuel injection device for injecting fuel through an injection hole according to claim 13, wherein the exhaust port is formed by the upstream end portion of the exhaust throttle part, and a virtual region as an extension from the exhaust port in the radial direction is the extension region, the extension region has an inside region disposed on a side close to the depressed opposite part, and an outside region disposed on a side outer than the inside region, and the length dimension of the inside region is smaller than the length dimension of the outside region but larger than the depression dimension of the pin stepped-surface in the radial direction of the pressing passage.

17. The fuel injection device for injecting fuel through an injection hole according to claim 16, wherein the length dimension of the outside region is larger than the step dimension of the passage stepped-surface.

18. The fuel injection device for injecting fuel through an injection hole according to claim 13, wherein the exhaust port is formed by the upstream end portion of the exhaust throttle part, and a virtual region as an extension from the exhaust port in the radial direction is the extension region, the extension region has an inside region disposed on a side close to the depressed opposite part, and the outside region disposed on a side outer than the inside region, and the outer circumferential area of the inside region is larger than the channel area of the exhaust throttle part.

* * * * *